US009990890B2

(12) United States Patent
Kawai et al.

(10) Patent No.: US 9,990,890 B2
(45) Date of Patent: Jun. 5, 2018

(54) DISPLAY DEVICE AND CONTROL METHOD THEREFOR

(71) Applicant: CANON KABUSHIKI KAISHA, Tokyo (JP)

(72) Inventors: Tatsundo Kawai, Hadano (JP); Hironobu Hoshino, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 15/191,985

(22) Filed: Jun. 24, 2016

(65) Prior Publication Data

US 2016/0379575 A1 Dec. 29, 2016

(30) Foreign Application Priority Data

Jun. 26, 2015 (JP) ..... 2015-129051

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2300/023* (2013.01); *G09G 2320/0233* (2013.01); *G09G 2320/0686* (2013.01)

(58) Field of Classification Search
CPC ..... G09G 2330/021; G09G 3/3406; G09G 3/3648
See application file for complete search history.

(56) References Cited

U.S. PATENT DOCUMENTS 6,545,653 B1 * 4/2003 Takahara ..... G02F 1/1334 345/100
2010/0238189 A1 9/2010 Feng
2015/0302806 A1 * 10/2015 Tada ..... G09G 3/3413 345/88
2016/0042701 A1 * 2/2016 Furumoto ..... G09G 3/3426 345/694

FOREIGN PATENT DOCUMENTS

JP 2012-516458 A 7/2012

* cited by examiner

*Primary Examiner* — Ricardo L Osorio
(74) *Attorney, Agent, or Firm* — Cowan, Liebowitz & Latman, P.C.

(57) ABSTRACT

A display device including: a light emitting unit including a plurality of light sources; a second panel configured to adjust transmittance of light from the light emitting unit; and a first panel configured to adjust transmittance of light from the second panel, further including: a first control unit configured to perform first control with respect to the first panel for controlling transmittance of each pixel on the basis of the image data; and a second control unit configured to perform, in a case where an image area of low brightness is adjacent to an image area of high brightness in the image data, second control for making transmittance of the second panel at a partial area corresponding to the image area of low brightness be lower than transmittance of the second panel at a partial area corresponding to the image area of high brightness.

20 Claims, 23 Drawing Sheets

IMAGE

| | | | | | | | | |
|---|---|---|---|---|---|---|---|---|
| | | | | | | | | |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 1 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | | | | ... | | | | |
| | | | | | | | | |

IMAGE DATA

SOBEL OPERATOR
(HORIZONTAL)

| | | |
|---|---|---|
| −1 | 0 | 1 |
| −2 | 0 | 2 |
| −1 | 0 | 1 |

Fig.10A

SOBEL OPERATOR
(VERTICAL)

| | | |
|---|---|---|
| −1 | −2 | −1 |
| 0 | 0 | 0 |
| 1 | 2 | 1 |

Fig.10B

SOBEL OPERATOR (HORIZONTAL) IS MADE TO OPERATE TO IMAGE DATA

| | | | | | | | | |
|---|---|---|---|---|---|---|---|---|
| | | | | | | | | |
| | | | | | | | | |
| | | 0 | 0 | 0 | 0 | 0 | | |
| | | 0 | 1 | 0 | −1 | 0 | | |
| | ··· | 0 | 2 | 0 | −2 | 0 | ··· | |
| | | 0 | 1 | 0 | −1 | 0 | | |
| | | 0 | 0 | 0 | 0 | 0 | | |
| | | | | | | | | |
| | | | | | | | | |

Fig.11A

SOBEL OPERATOR (VERTICAL) IS MADE TO OPERATE TO IMAGE DATA

| | | | | | | | | |
|---|---|---|---|---|---|---|---|---|
| | | | | | | | | |
| | | | | | | | | |
| | | 0 | 0 | 0 | 0 | 0 | | |
| | | 0 | 1 | 2 | 1 | 0 | | |
| | ··· | 0 | 0 | 0 | 0 | 0 | ··· | |
| | | 0 | −1 | −2 | −1 | 0 | | |
| | | 0 | 0 | 0 | 0 | 0 | | |
| | | | | | | | | |
| | | | | | | | | |

Fig.11B

ABSOLUTE SUM OF RESULTS OF (A) AND (B)

| | | | | | | | | |
|---|---|---|---|---|---|---|---|---|
| | | | | | | | | |
| | | | | | | | | |
| | | 0 | 0 | 0 | 0 | 0 | | |
| | | 0 | 2 | 2 | 2 | 0 | | |
| | ··· | 0 | 2 | 0 | 2 | 0 | ··· | |
| | | 0 | 2 | 2 | 2 | 0 | | |
| | | 0 | 0 | 0 | 0 | 0 | | |
| | | | | | | | | |
| | | | | | | | | |

Fig.11C

LAPLACE OPERATOR 3x3

| | | |
|---|---|---|
| −1 | −1 | −1 |
| −1 | 8 | −1 |
| −1 | −1 | −1 |

*Fig.13*

LAPLACE OPERATOR IS MADE TO OPERATE TO IMAGE DATA

| | | | | | | | | |
|---|---|---|---|---|---|---|---|---|
| | | | | | | | | |
| | | | | | | | | |
| | | 0 | 0 | 0 | 0 | 0 | | |
| | | 0 | −1 | −1 | −1 | 0 | | |
| | ··· | 0 | −1 | 8 | −1 | 0 | ··· | |
| | | 0 | −1 | −1 | −1 | 0 | | |
| | | 0 | 0 | 0 | 0 | 0 | | |
| | | | | | | | | |
| | | | | | | | | |

*Fig.14*

CONTROL A

CONTROL B

IDEAL

CONTROL A

CONTROL B

DISPLAY DEVICE AND CONTROL METHOD THEREFOR

BACKGROUND OF THE INVENTION

Field of the Invention

The present invention is related to a display device and a control method of the same.

Description of the Related Art

In recent years, image quality of display devices for displaying image information such as TV monitors, PC monitors, and various industrial monitors has been significantly improved. Furthermore, as a future trend of high image quality video systems, video systems compatible with a high dynamic range (HDR) are now being proposed. In regard of a display part that is in charge of display, there is a technology for cooperatively modulating a liquid crystal panel and a backlight light source, with the backlight being constituted of a plurality of individually controllable light sources enabling area control, as a technology for expanding a dynamic range of a liquid crystal display. Here, such a technology is referred to as dual modulation display control.

SUMMARY OF THE INVENTION

However, the conventional dual modulation display control has a problem in that, when displaying an image having a bright image with a dark background, for instance, an artifact called "halo", which produces pale shine around the bright image, is generated thereby reducing image quality. A method described in Japanese Translation of PCT Application No. 2012-516458 is one method for solving this problem.

Japanese Translation of PCT Application No. 2012-516458 discloses an area adaptive backlight type display device and a method for reducing an artifact caused by a halo effect. The method makes it possible to render a halo inconspicuous by controlling, even for a dark background part, the corresponding light emitting diodes (LEDs) so as to emit light not too weakly but with a certain brightness. However, the technology has a problem in that a dark background part cannot be displayed sufficiently black.

In the circumstances described above, the present invention provides a display device which suppresses generation of a halo around an image of high brightness while suppressing black floating of an image of low brightness.

A first mode of the present invention is a display device including:

light emitting unit including a plurality of light sources for which light emission can be controlled independently;

a second panel configured to adjust transmittance of light from the light emitting unit;

a first panel configured to adjust transmittance of light from the second panel, the display device being configured to display an image based on image data, further including:

first control unit configured to perform first control with respect to the first panel for controlling transmittance of each pixel on the basis of the image data; and second control unit configured to perform, in a case where an image area of low brightness is adjacent to an image area of high brightness in the image data, second control for making transmittance of the second panel at a partial area corresponding to the image area of low brightness be lower than transmittance of the second panel at a partial area corresponding to the image area of high brightness.

A second mode of the present invention is a control method of a display device configured to display an image on the basis of image data, the display device including:

light emitting unit comprising a plurality of light sources for which light emission can be controlled independently;

a second panel configured to adjust transmittance of light from the light emitting unit; and a first panel configured to adjust transmittance of light from the second panel, the control method including:

a step of performing first control for controlling transmittance of the first panel for each pixel on the basis of the image data; and a step of performing second control for, in a case where an image area of low brightness is adjacent to an image area of high brightness in the image data, making transmittance of the second panel at a partial area corresponding to the image area of low brightness be lower than transmittance of the second panel at a partial area corresponding to the image area of high brightness.

The present invention provides a display device capable of suppressing generation of a halo around an image of high brightness and suppressing black floating of an image of low brightness.

Further features of the present invention will become apparent from the following description of exemplary embodiments with reference to the attached drawings.

BRIEF DESCRIPTION OF THE DRAWINGS

FIG. 10A and FIG. 10B are views illustrating examples of Sobel operators of Example 1;

FIG. 11A to FIG. 11C are views illustrating examples of results after the Sobel operators are made to operate, of Example 1;

FIG. 13 is a view illustrating an example of a Laplace operator of Example 1;

FIG. 14 is a view illustrating an example of a result after the Laplace operator of Example 1 is made to operate;

DESCRIPTION OF THE EMBODIMENTS

Comparative Example

With the purpose of rendering the explanation of the present invention clearer, a comparative example will be described first. As Comparative Example 1, examples of two kinds of halo control in dual modulation display control will be illustrated.

Figure 17:
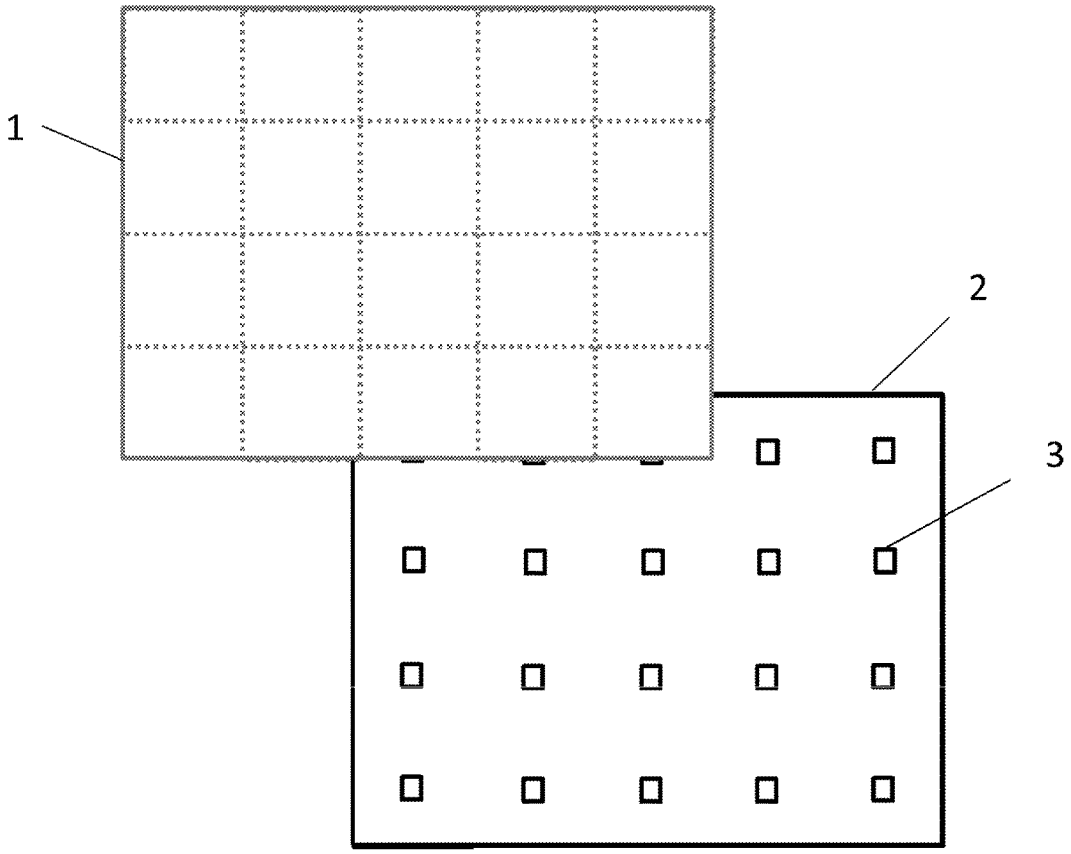
FIG. 17 is a view illustrating a configuration example of dual modulation display control associated with Comparison Example 1.

FIG. 17 illustrates a configuration example of Comparative Example 1. Members constituting a display device of Comparative Example 1 are a liquid crystal panel 1, a backlight 2, and a plurality of light sources 3. Light emission (brightness) can be controlled independently for the plurality of light sources 3. One example of the light source is an LED. When the light sources are constituted of LEDs, each light source as a control unit of independently performed light emission may be constituted of a single LED element or may be constituted of a plurality of LED elements. Below, when denoted as LED 3, it corresponds to an LED element or an LED element group serving as a control unit in the meaning described above.

A liquid crystal panel 1 is constituted of a plurality of virtual divided areas corresponding to each of the plurality of LEDs 3. In accordance with image data corresponding to each divided area, the LED 3 and the liquid crystal panel 1 are controlled. When an image corresponding to a divided area is a bright image, light is strongly emitted from the corresponding LED 3. When an image corresponding to a divided area is a dark image, light is weakly emitted from the corresponding LED 3. With such an area control, image display of a wide dynamic range exceeding a dynamic range of the liquid crystal panel 1 can be performed.

Figure 18:
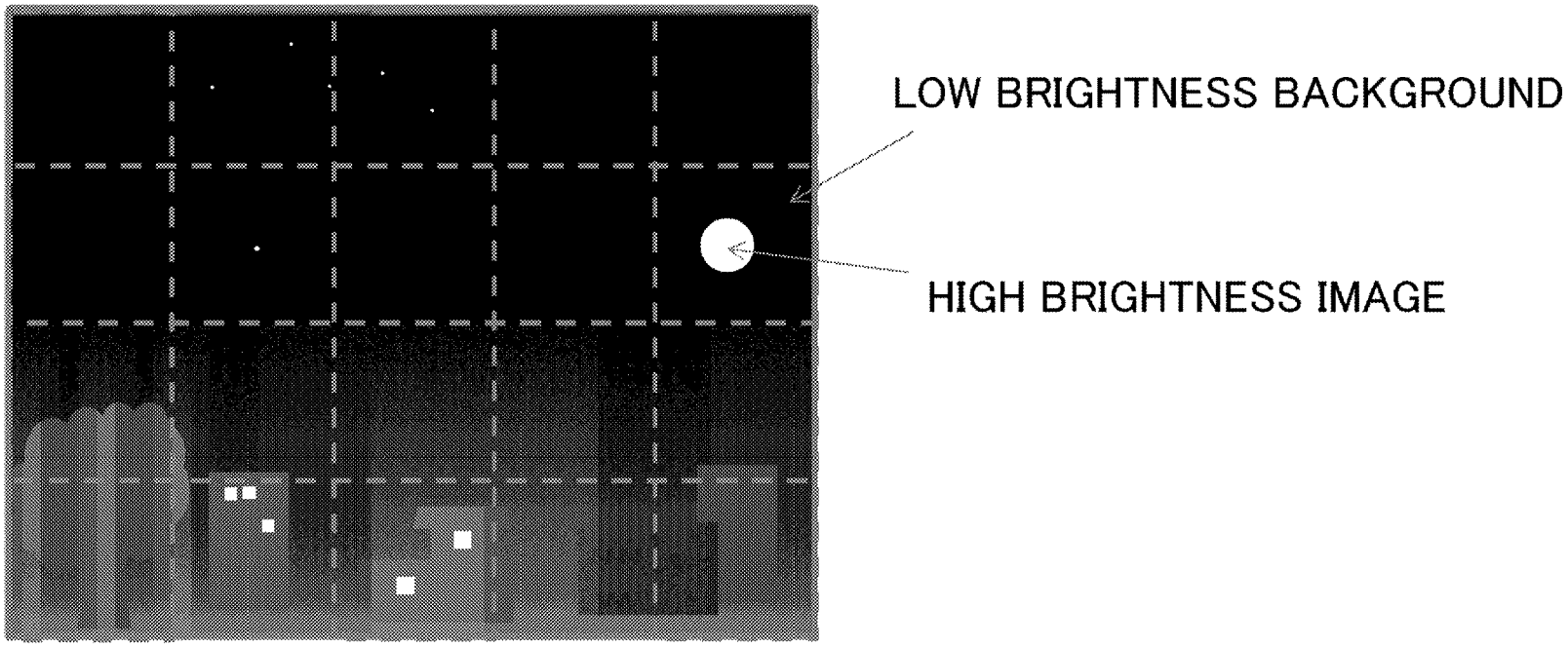
FIG. 18 is a view illustrating an image example in which an area of low brightness and an area of high brightness are adjacent to each other.
Figure 19:
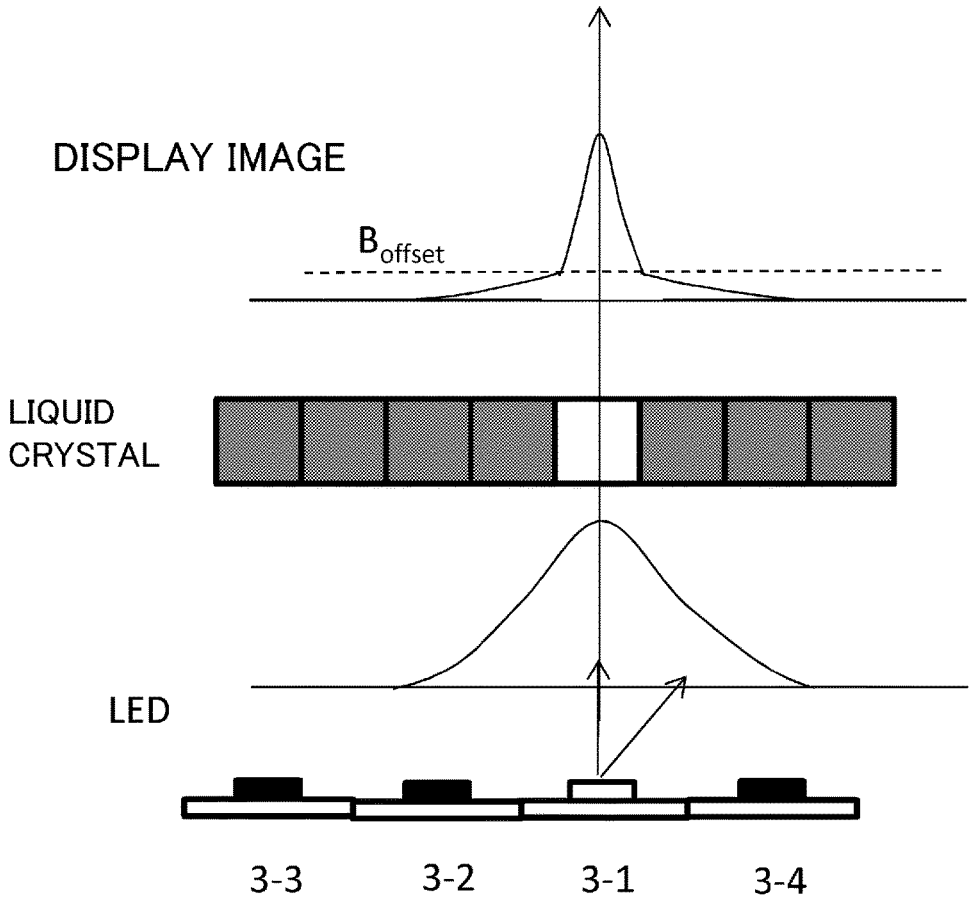
FIG. 19 is a view illustrating a cross-section associated with control A of Comparison Example 1.

A control example will be described in a case, as illustrated in FIG. 18, where an image having a high brightness area in a background of a low brightness area is displayed. In FIG. 18, the low brightness area is an image of a dark night sky and the high brightness area is an image of a twinkling bright star. FIG. 19 is a schematic diagram illustrating display brightness at a part containing high brightness area, liquid crystal panel control, and backlight brightness. To brightly display an image of the high brightness area, an LED 3-1 corresponding to the high brightness area is so controlled as to brightly emit light. On the other hand, as for the low brightness area, to sufficiently express darkness of a dark part background, corresponding LEDs 3-2, 3-3, 3-4 are so controlled as to either emit light with low brightness or be put out. Such control is referred to as control A. When controlled in such a way, however, halo becomes conspicuous in the display. Reasons therefor are as follows.

Typically, actual transmittance of each pixel of a liquid crystal panel is not zero even when a control value is zero. Therefore, even at a place where black is displayed, when irradiation light from a backlight is intense, light leakage is caused and the place is displayed with a certain degree of brightness. Also in an example in FIG. 18, a dark background part near the star image is displayed with a certain degree of brightness $B_{offset}$ caused by bright light of the LED 3-1 being leaked. On the other hand, at a part away from the star image, LEDs 3-2, 3-3, 3-4 are put out. Therefore, even when transmittance of a liquid crystal is not zero, there is almost no influence of leakage light, and display brightness of a low brightness area at these positions is lower than the brightness $B_{offset}$ in the low brightness area near the star where there is a light leakage. In other words, when the same black image is displayed, surroundings of a star image are a displayed somewhat brightly and this is visually recognized as a halo.

Figure 20:
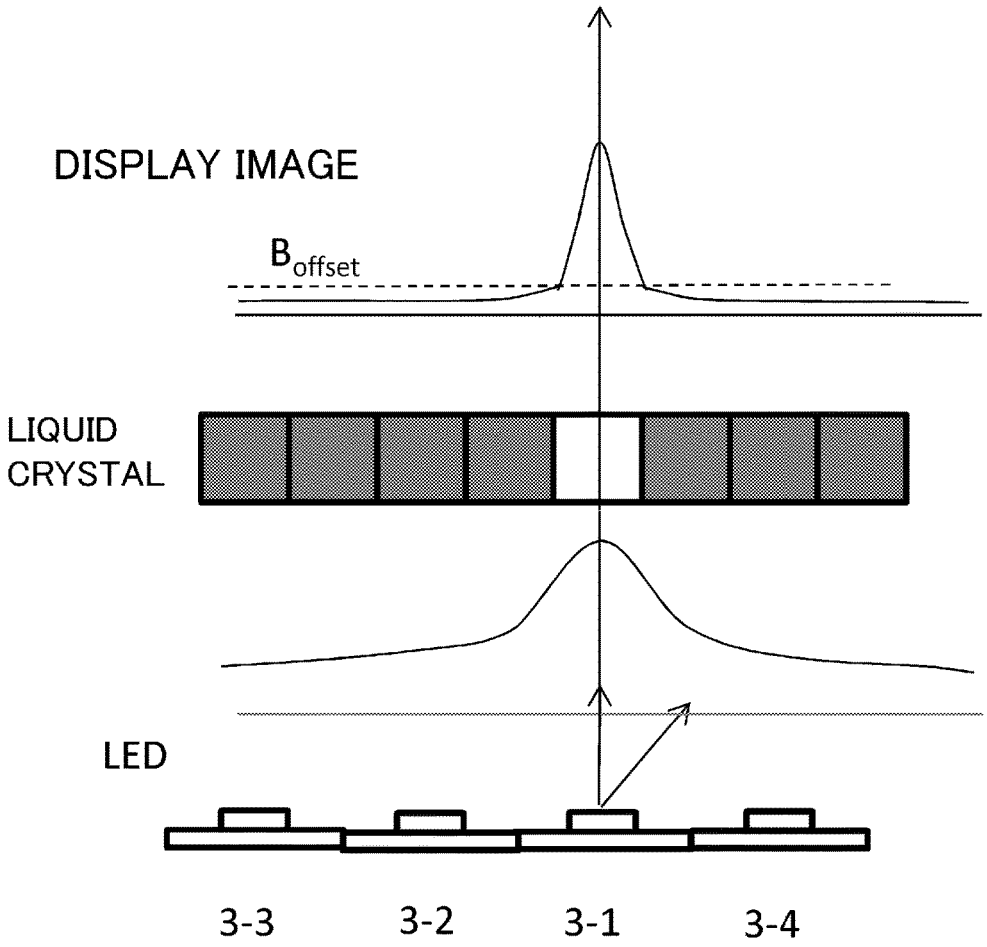
FIG. 20 is a view illustrating a cross-section associated with control B of Comparison Example 1.
Figure 21A:
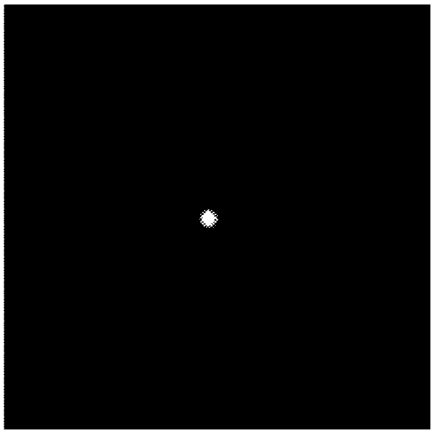
FIG. 21A to FIG. 21C are views illustrating halos of Comparison Example 1.
Figure 21B:
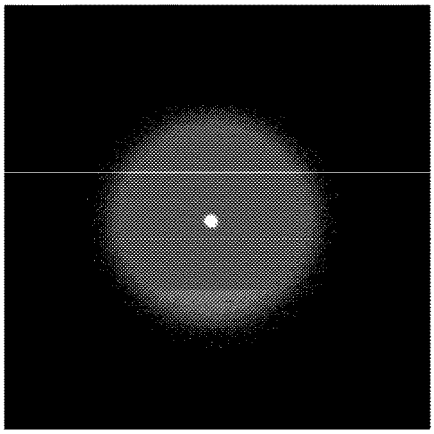
Figure 21C:
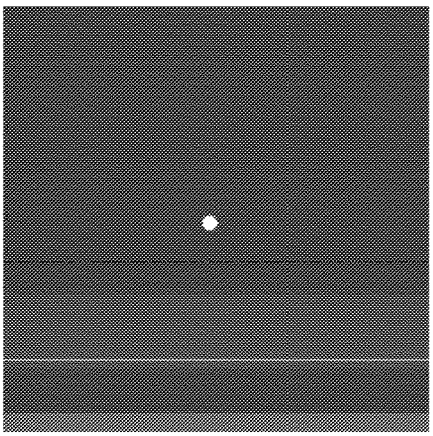

To solve the problem in a dual modulation display control, performing the following control B may be considered. FIG. 20 is a schematic diagram illustrating display brightness at a part containing a high brightness area, liquid crystal panel control, and backlight brightness, when the control B is performed. In the control B, to make a halo inconspicuous, LED 3-2, 3-3, 3-4, located at positions away from the star image are controlled so as to emit light as well. In this way, in a dual modulation display control, by controlling so that LEDs corresponding to a low brightness area emit light with a certain level of brightness without extensively reducing the brightness of the LEDs, a halo around the high brightness area (star image) becomes inconspicuous. However, brightness of the low brightness area cannot be sufficiently reduced. Appearance of a display in each case of control (A) and control (B) is illustrated in FIG. 21. FIG. 21A illustrates an ideal display faithful to image data. FIG. 21B illustrates a display in the case of the control (A). FIG. 21C illustrates a display in the case of the control (B).

Figure 22:
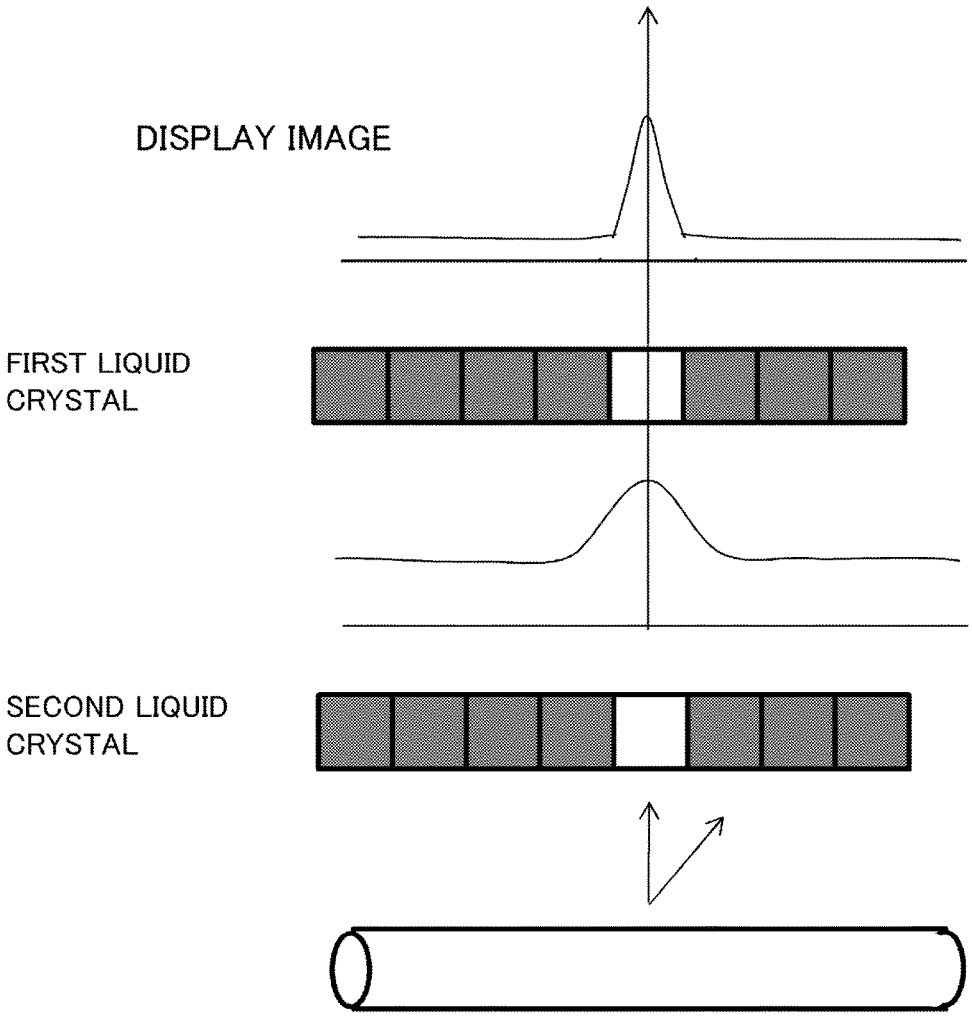
FIG. 22 is a view illustrating a combination of a single light source and a liquid crystal panel of coarse pixels of Comparison Example 2.

FIG. 22 illustrates Comparative Example 2, which is a different example. This Comparative Example is also an example of a dual modulation display control. In the Comparative Example, a backlight does not have a configuration constituted of a plurality of light sources whose light-emission is independently controllable. In Comparative Example 2, the backlight has a configuration that can be simulatively area-controllable by combining a single light source and a liquid crystal panel (the second liquid crystal panel) of coarse pixels. However, in this case as well, since transmittance of the second liquid crystal panel is not 0 even with a control value being 0, display brightness of a black image cannot be sufficiently reduced.

In this way, it has been difficult with the conventional dual modulation display control to achieve both suppression of a halo and sufficient suppression of display brightness of a black image.

EXAMPLE 1

Below, the present invention will be described in detail with reference to an Example.

A display device of Example 1 includes: light-emitting unit (backlight) having a plurality of light sources for which light emission can be controlled independently; a second panel (second liquid crystal panel), for adjusting transmittance of light from the light emitting unit; and a first panel (first liquid crystal panel) for adjusting transmittance of light from the second panel. The display device has a structure provided with the second liquid crystal panel, for correcting a halo, disposed between the first liquid crystal panel for image display and the backlight, and displays an image based on input image data by cooperatively modulating the plurality of liquid crystal panels and the backlight. Such modulation control is, hereinafter, referred to as a triple modulation display control. With the triple modulation display technique, display brightness of a low brightness area adjacent to a high brightness area can be made even lower than the $B_{offset}$, while keeping the brightness of the high brightness area. Therefore, by reducing the brightness level of a halo, the halo can be made inconspicuous, and reduction in display brightness of the high brightness area can be suppressed. Details will be described below.

Figure 1:
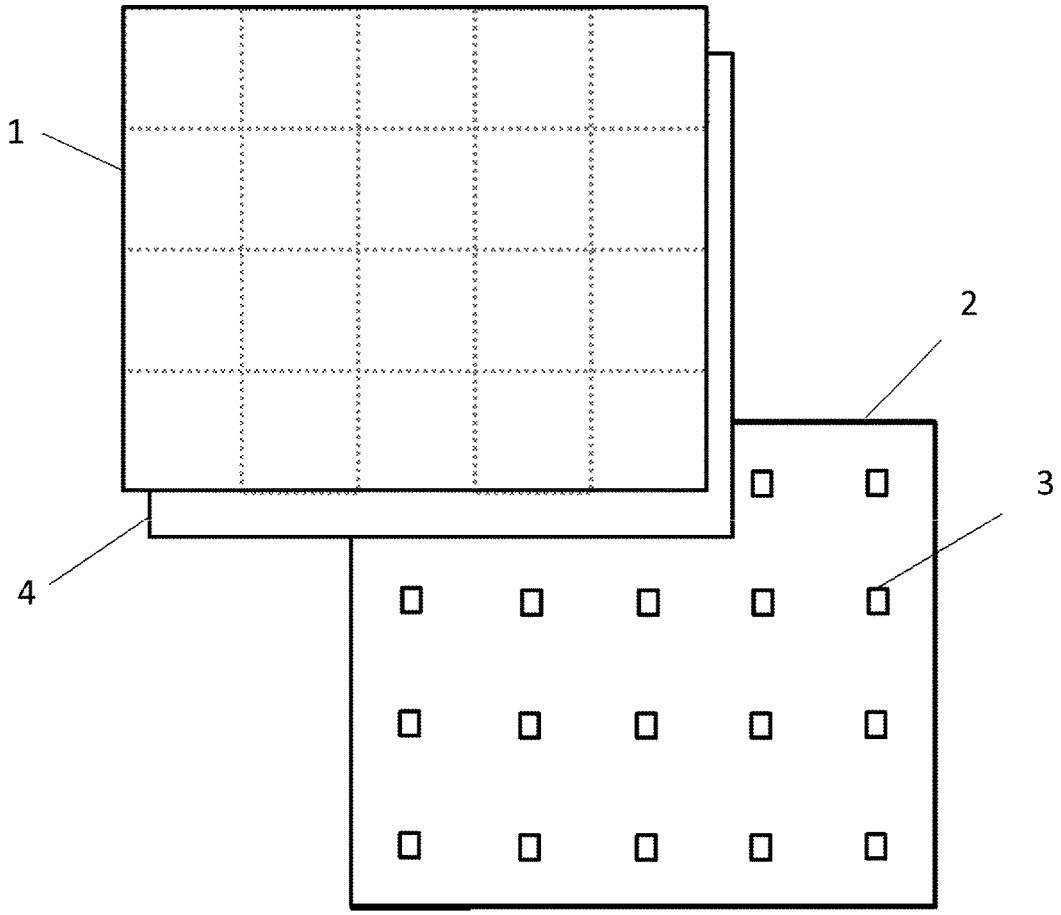
FIG. 1 is a view illustrating a configuration of a display device of Example 1.

FIG. 1 illustrates a configuration diagram of a display device of Example 1 of the present invention. Although FIG. 1 is a view in which members constituting the display device of Example 1 are separately drawn for the sake of being easily understood, these members actually are to be assembled to constitute the display device. Members constituting the display device include: the first liquid crystal panel 1, the backlight 2, the light source 3, and the second liquid crystal panel 4. Light emission (brightness) can be controlled independently for the plurality of light sources 3. Light sources 3 are LEDs, for instance. When constituting the light sources with LEDs, each light source, which is a light control unit of independently performing light emission, may be constituted of a single LED element, or may be constituted of a plurality of LED elements. Hereinafter, when being denoted as LED 3, it corresponds to an LED element or an LED element group as a control unit in the meaning described above.

The first liquid crystal panel 1 is constituted of a plurality of virtual divided areas corresponding to each of the plurality of LEDs 3. In accordance with image data corresponding to each of the divided areas, control of the LEDs 3 and control of the first and second liquid crystal panels are performed. When an image corresponding to a divided area is a bright image, a corresponding LED 3 is controlled to intensely emit light. When an image corresponding to a divided area is a dark image, a corresponding LED 3 is controlled to weakly emit light or be put out.

The second liquid crystal panel 4 is a liquid crystal panel provided between the first liquid crystal panel 1 and the LEDs 3. In Example 1, control for cooperatively modulating the plurality of liquid crystal panels and the backlight light sources is performed. Such modulation control is referred to as triple modulation display control.

Figure 2:
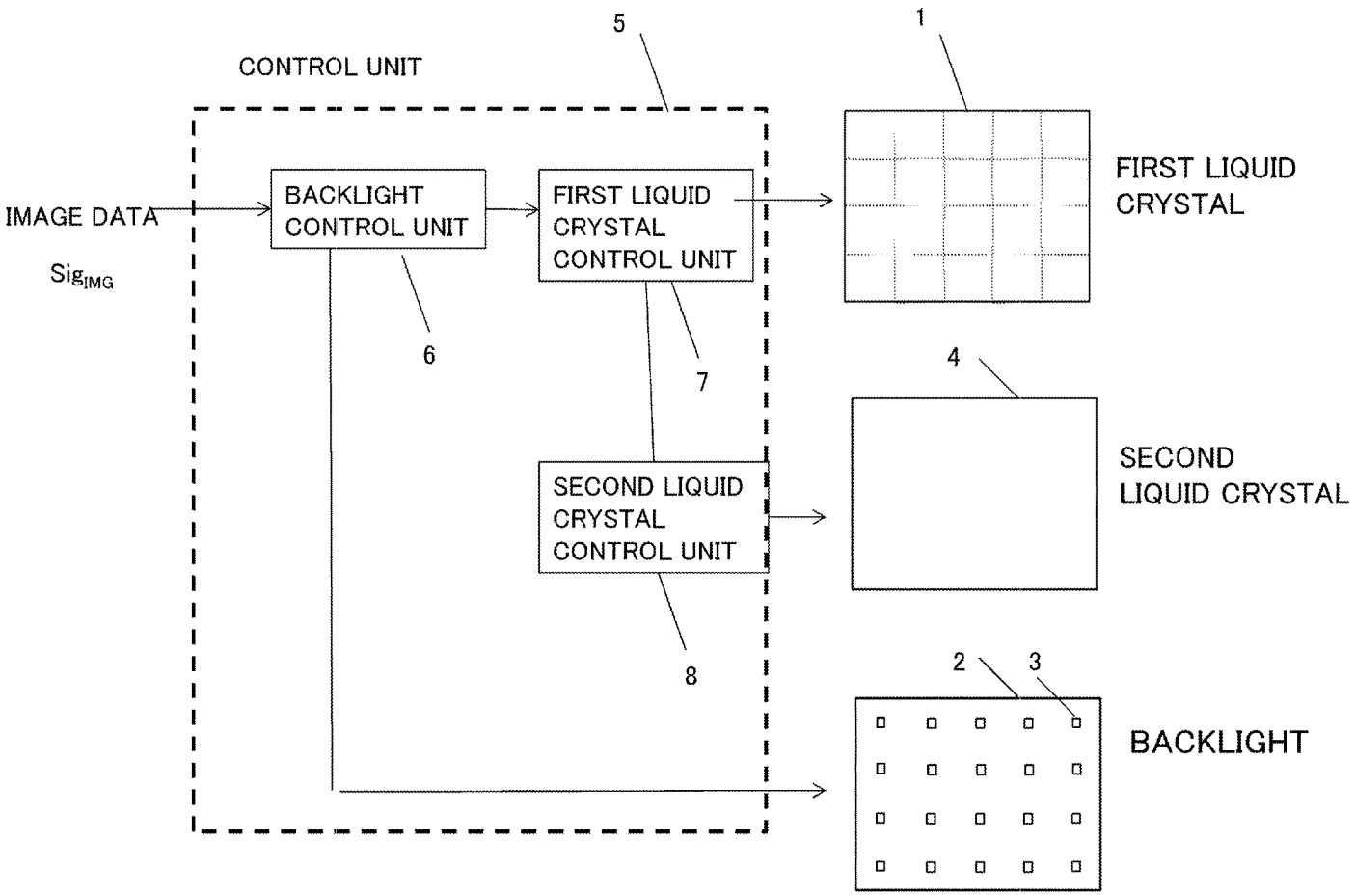
FIG. 2 is a view illustrating a control block of a triple modulation display technology of Example 1.

FIG. 2 is a block diagram schematically illustrating a function constituting a control unit 5, which achieves triple modulation display control in Example 1. To the control unit 5, image data $Sig_{IMG}$ is input. The control unit 5 performs the triple modulation display control for simultaneously and cooperatively modulating the plurality of liquid crystal panels and the backlight light source in accordance with the image data $Sig_{IMG}$. In Example 1, the control unit 5 is constituted of the following functional parts.

The backlight control unit 6 generates a signal for controlling the backlight light source in accordance with the image data $Sig_{IMG}$. The backlight control unit 6 is third control unit for controlling brightness of each light source on the basis of a feature amount of the image data (brightness, for instance) at an area (divided area) corresponding to each light source (LED).

A first liquid crystal control unit 7 generates a signal for controlling the first liquid crystal panel 1. The first liquid crystal control unit 7 is first control unit for performing first control with respect to the first liquid crystal panel 1 for controlling transmittance for each pixel on the basis of the image data.

A second liquid crystal control unit 8 generates a signal for correcting a halo by controlling the second liquid crystal panel 4.

Although, in Example 1, an example is given in which the control unit 5 includes each of the functional parts described above, it is not necessarily required to be separated into clear elements. It is acceptable when the control unit 5 has a function of simultaneously and cooperatively modulating a plurality of liquid crystal panel and a backlight light source in a comprehensive manner.

In Example 1, a case where an image of FIG. 18 described above is displayed will be described.

Figure 3:
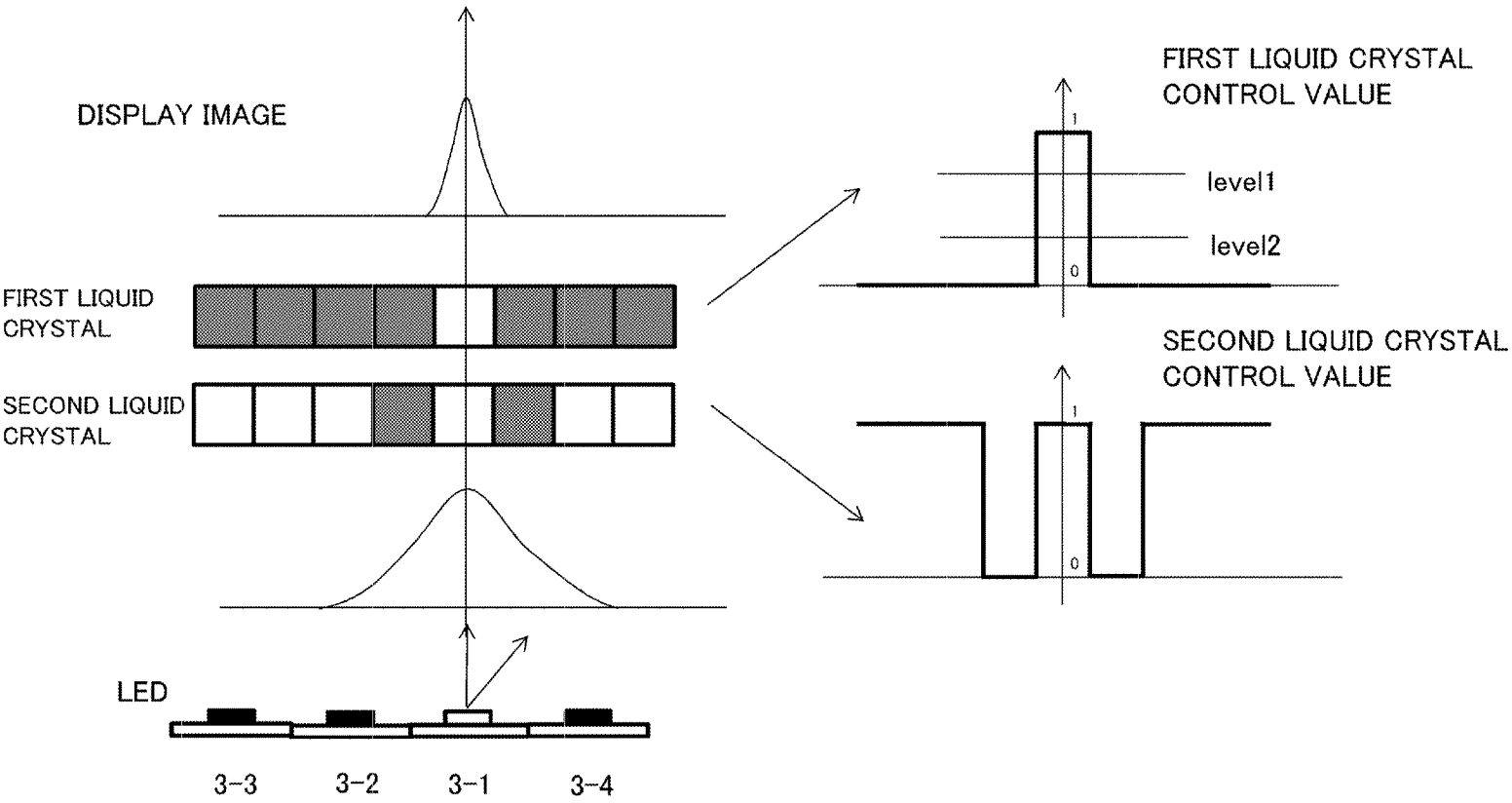
FIG. 3 is a view illustrating control of a second liquid crystal panel 4 and a display image of Example 1.

FIG. 3 illustrates a cross-sectional schematic diagram of a display device in Example 1 where an image area of low brightness (an image of dark night sky, a dark part background, and such; hereinafter referred to as a low brightness area) and an image area of high brightness (an image of a star, a bright spot, and such; hereinafter referred to as a high brightness area) of FIG. 18 are adjacent to each other. On the left side of FIG. 3, from the top, a display brightness distribution (a brightness distribution of transmitted light of the first liquid crystal panel) of the display device, control states of the first and second liquid crystal panels for each pixel, a brightness distribution of light of the backlight, and a lighting state of each LED are illustrated. The LED 3-1 corresponding to an area having a high brightness area is controlled so as to emit light with high brightness. In a low brightness area, to sufficiently express darkness, corresponding LEDs 3-2, 3-3, 3-4 are controlled so as to emit light with low brightness or be put out.

On the right side of FIG. 3, control signals for controlling each of the first liquid crystal panel 1 and second liquid crystal panel 4 are schematically illustrated. A vertical axis represents a normalized value by making a maximum value of a control signal be 1. A horizontal axis represents a pixel position. Although a maximum value of a control signal is 255 in 8 bit control, for instance, and a maximum value is 1023 in 10 bit control, in the description of the present invention, values normalized by the maximum value are used. Although transmittance of a pixel of a liquid crystal panel is not necessarily proportional to a control value due to gamma correction, they are premised to be proportional in the description of the present invention for the sake of simplicity.

The second liquid crystal control unit 8 is second control unit for performing second control for controlling the second liquid crystal panel 4 to make transmittance of a pixel of a partial area corresponding to a high brightness area be high and make transmittance of a pixel of a partial area corresponding to a low brightness area be lower than the transmittance of the pixel of the partial area corresponding to the high brightness area. The second liquid crystal control unit 8 performs the control by analyzing image data $Sig_{IMG}$. Here, the partial area of the second liquid crystal panel 4 corresponding to the low brightness area is a partial area adjacent to the partial area of the second liquid crystal panel 4 corresponding to the high brightness area. Here, inter-pixel distances of the first liquid crystal panel 1 and an inter-pixel distance of the second liquid crystal panel 4 are equal, and the first liquid crystal panel 1 and the second liquid crystal panel 4 have the same pixel configuration. Therefore, the partial area of the second liquid crystal panel 4 corresponding to the high brightness area correspond to pixels of the second liquid crystal panel 4 located in the same positions as the pixels constituting the high brightness area. The partial area of the second liquid crystal panel 4 corresponding to the low brightness area corresponds to pixels of the second liquid crystal panel 4 adjacent to the pixels constituting the high brightness area. Thereby, it becomes possible to make display brightness of the low brightness area adjacent to the high brightness area be even lower than the $B_{offset}$. Thus, the brightness level of a halo becomes low and the halo becomes inconspicuous. Furthermore, since the transmittance of the second liquid crystal panel 4 is made to be high at a position of a pixel in the high brightness area, reduction in display brightness of the high brightness area is suppressed and a display faithful to input image data becomes possible.

Figure 23:
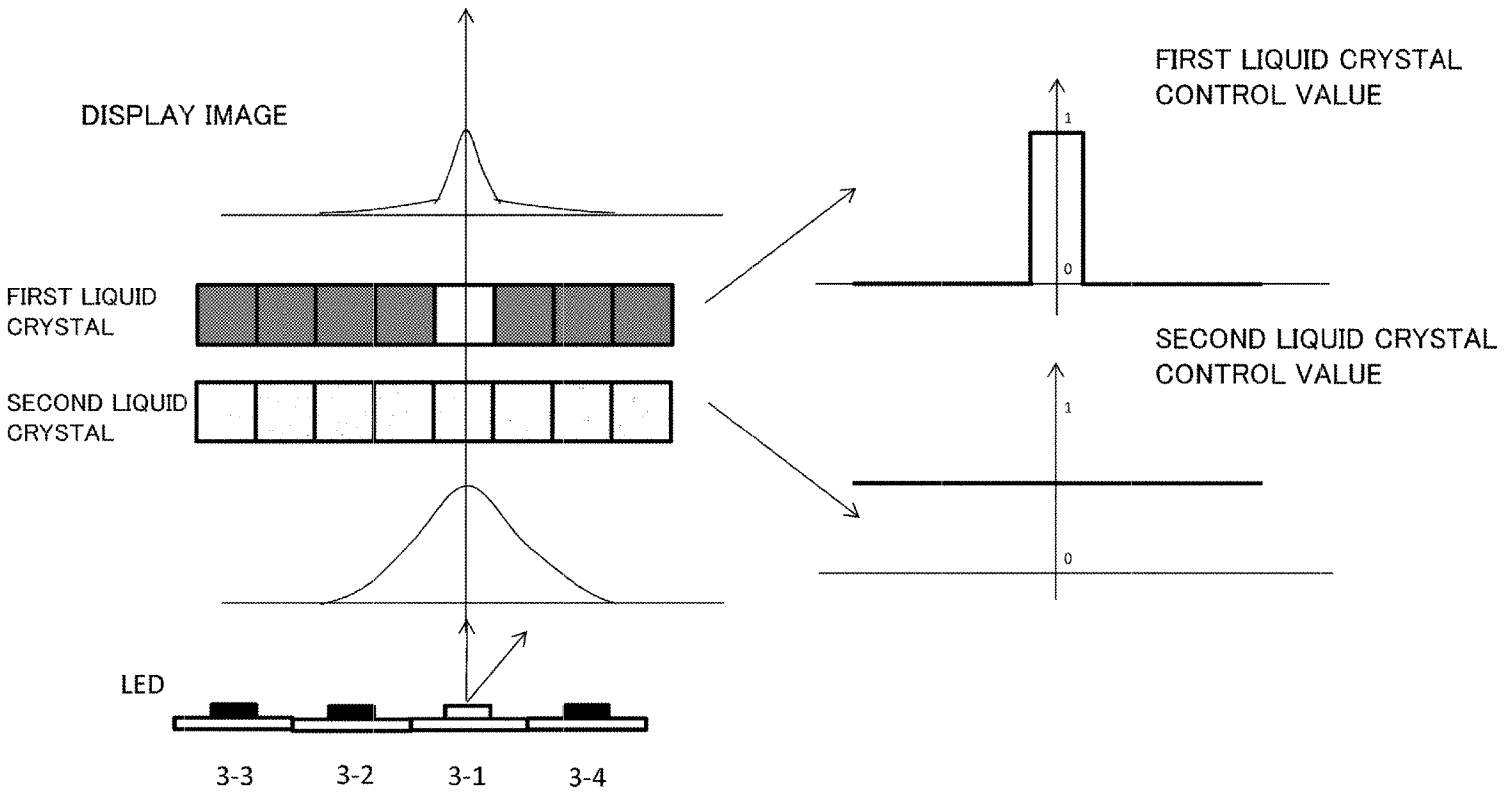
FIG. 23 is a view illustrating Comparison Example 3.

The second liquid crystal panel 4 is required to be appropriately controlled in accordance with image data. FIG. 23 illustrates Comparative Example 3 illustrating a case where the second liquid crystal panel 4 is not appropriately controlled in a triple modulation display control. In Comparative Example 3, a pixel of the second liquid crystal panel 4 is controlled so as to have uniform transmittance (for instance, 0.5) in both of the high brightness area and the low brightness area. In this case, although the brightness level of a halo can be reduced to a greater extent than in the conventional case, the display brightness of the high brightness area is also reduced at the same time, making it impossible to achieve a display faithful to the input image data.

FIG. 3 will be described again. A position of a low brightness area adjacent to the high brightness area where the transmittance of a pixel of the second liquid crystal panel 4 is reduced can be identified by detecting a boundary between the high brightness area and the low brightness area on the basis of image data. In Example 1, the following specific processing is performed at the control unit 5 illustrated in FIG. 2.

The second liquid crystal control unit 8 determines whether an area is the high brightness area on the basis of a first reference value level 1 and determines whether an area is the low brightness area on the basis of a second reference value level 2. When, in the image data $Sig_{IMG}$, a pixel having a brightness level higher than the level 1 and a pixel having a brightness level lower than the level 2 are adjacent to each other, the second liquid crystal control unit 8 determines the pixel having the brightness lower than the level 2 to be a pixel of the low brightness area adjacent to the high brightness area. In other words, when, in the image data, areas whose difference in brightness is greater than or equal to a threshold are adjacent to each other, the second liquid crystal control unit 8 determines that an image area of high brightness and an image area of low brightness are adjacent to each other.

Depending on a distance between the first liquid crystal panel 1 and the second liquid crystal panel 4, a light flux that passes through a pixel of the second liquid crystal panel 4 may become spread to a certain extent before reaching the first liquid crystal panel 1. In this case, the second liquid crystal control unit 8 may perform control so as to keep the transmittance of a pixel of the second liquid crystal panel 4 immediately adjacent to the high brightness area to be high and reduce the transmittance of pixels located away from the high brightness area to a certain extent (e.g. a location further on an outer side from the immediately adjacent pixel or a location yet further on an outer side).

Figure 4:
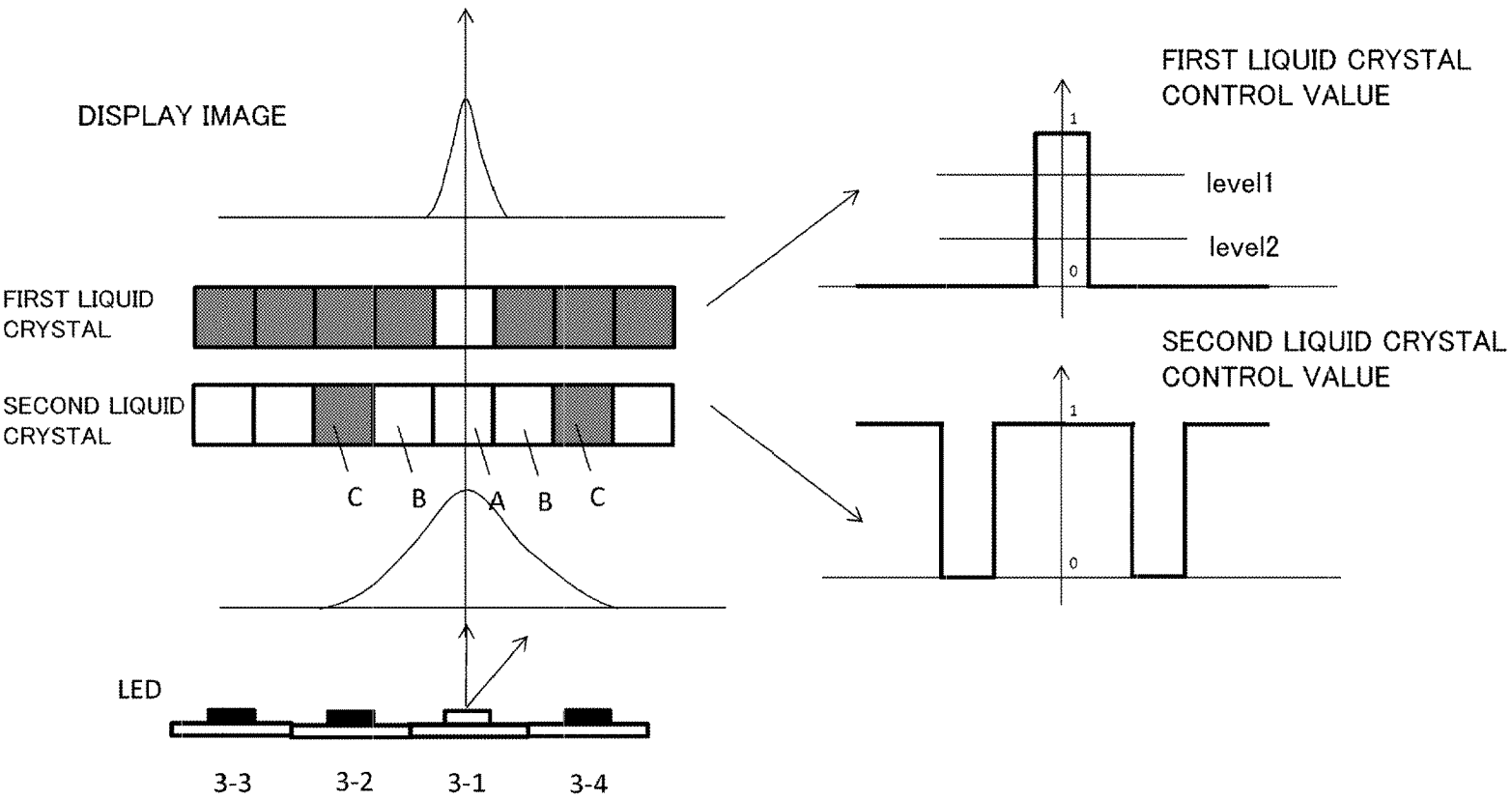
FIG. 4 is a view illustrating control of the second liquid crystal panel 4 and a display image of Example 1.

FIG. 4 illustrates a case where a partial area of the second liquid crystal panel 4 corresponding to the low brightness area is a partial area located at a predetermined distance from a partial area of the second liquid crystal panel 4 corresponding to the high brightness area. Here, a case is illustrated where the transmittance of a partial area between the partial area of the second liquid crystal panel 4 corresponding to the high brightness area and the partial area of the second liquid crystal panel 4 corresponding to the low brightness area is controlled to be the same as the transmittance of the partial area of the second liquid crystal panel 4 corresponding to the high brightness area. By controlling the transmittance of a pixel of the second liquid crystal panel 4 located away from the high brightness area to be low, a halo is suppressed. In FIG. 4, the second liquid crystal control unit 8 performs control so as to keep the transmittance of pixels B of the second liquid crystal panel 4 immediately adjacent to a high brightness area A to be high without reducing it and reduce the transmittance of pixels C located further on an outer side therefrom. Here, illustrated is a case where the predetermined distance is a distance based on a degree of spread of a light flux from the light source. Since, even when a light flux from the light source is spread as it travels toward a liquid crystal panel, the transmittance of the pixels C of the second liquid crystal panel 4 located at a position where the spread light flux arrives is reduced, generation of a halo attributed to the spread light flux can be suppressed. Similarly to the case of FIG. 3, since reduction in an amount of the light flux that arrives at the pixel A corresponding to the high brightness area of the first liquid crystal panel 1 is suppressed, the display brightness of the high brightness area can be kept high. Also, similarly to the case of FIG. 3, the inter-pixel distance of the first liquid crystal panel 1 and the inter-pixel distance of the second liquid crystal panel 4 are equal and the first liquid crystal panel 1 and the second liquid crystal panel 4 have the same pixel configuration. Therefore, the partial area of the second liquid crystal panel 4 corresponding to the high brightness area is constituted of pixels of the second liquid crystal panel 4 located at the same position as pixels constituting the high brightness area. The partial area of the second liquid crystal panel 4 corresponding to the low brightness area is constituted of pixels of the second liquid crystal panel 4 located at a predetermined distance from the pixels constituting the high brightness area.

However, when pixels of the second liquid crystal panel 4 whose transmittance is to be controlled to be low is set at a position located far from a boundary between the high brightness area and the low brightness area adjacent thereto, an effect of reducing the brightness level of a halo becomes small. Determination of positions of the pixels of the second liquid crystal panel 4, whose transmittance is made to be low, for suppressing a halo is to be made such that, subjectively, the most desirable result can be obtained while taking account of a balance between securement of brightness of the high brightness area and the effect of reducing a halo. Typically, the selection may be appropriately made up to about 10 times a full width at half maximum of spread of a light flux passing through the pixels of the second liquid crystal panel 4 and arriving at the first liquid crystal panel 1 by making the full width at half maximum as a reference.

Figure 5:
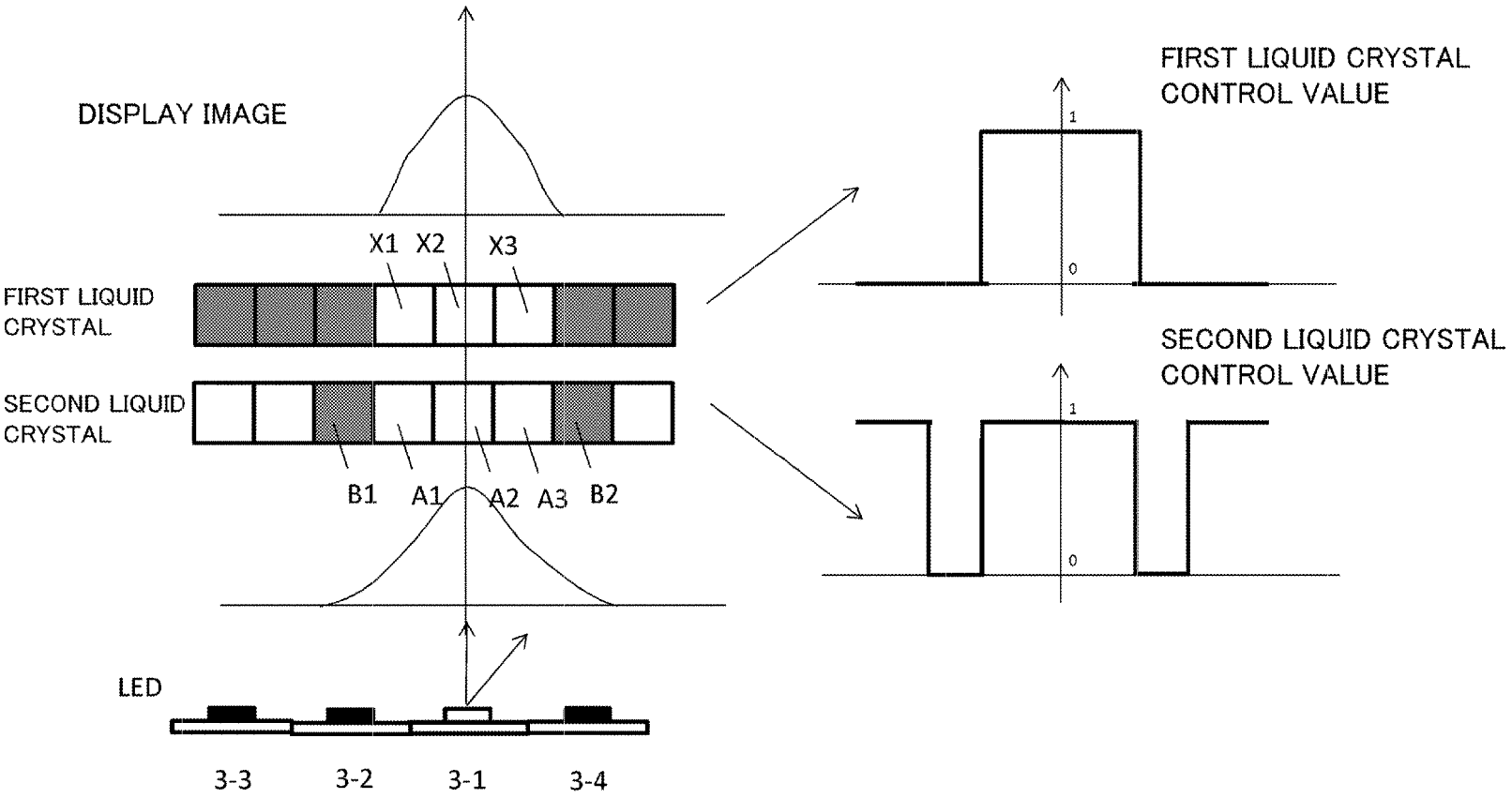
FIG. 5 is a view illustrating control of the second liquid crystal panel 4 and a display image of Example 1.

The high brightness area may not be a single image bright spot but may be an image with some expanse. FIG. 5 illustrates an example of a case where the high brightness area is an image with an expanse. In FIG. 5, the high brightness area is constituted of pixels X1, X2, X3. Pixels of the second liquid crystal panel 4 located at a position corresponding to the high brightness area are pixels A1, A2, A3. The second liquid crystal control unit 8 reduces the transmittance of pixels B1, B2 adjacent to the high brightness area of the second liquid crystal panel 4 for reducing a halo.

Figure 6:
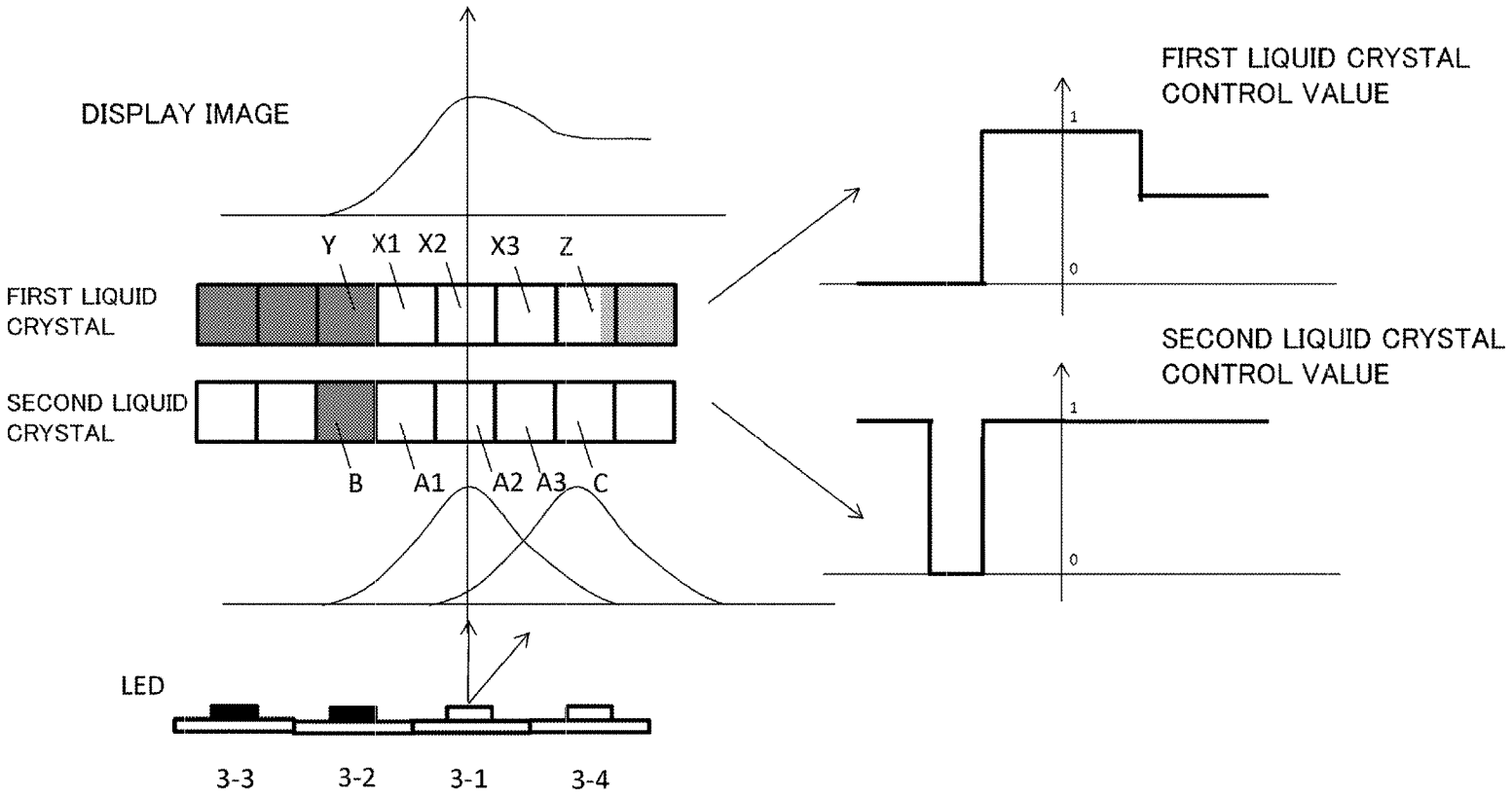
FIG. 6 is a view illustrating control of the second liquid crystal panel 4 and a display image of Example 1.

When the high brightness area has an expanse, transmittance of only partial area of pixels of the second liquid crystal panel 4 adjacent to the high brightness area may be reduced for reducing a halo. FIG. 6 illustrates a case where a first image area of low brightness having a brightness difference equal to or more than a threshold with respect to the high brightness area is adjacent to the high brightness area and a second image area of low brightness having a brightness difference smaller than the threshold with respect to the high brightness area is adjacent to the high brightness area on the opposite side to the first image area of low brightness. In this case, control for making the transmittance of the second liquid crystal panel 4 lower than the transmittance of the second liquid crystal panel 4 at the partial area corresponding to the high brightness area is performed only at the partial area corresponding to the first low brightness area. One example will be illustrated. In an example of FIG. 6, a high brightness area (X1, X2, X3) having a certain size is in contact with a low brightness area Y on one side, and on the other side, the high brightness area is not in contact with a low brightness area (but in contact with a high brightness area Z). In this case, the transmittance of the pixel B of the second liquid crystal panel 4 adjacent to the high brightness area on the side in contact with the low brightness area Y is made to be low with respect to the pixels (A1, A2, A3) of the second liquid crystal panel 4 corresponding to the high brightness area (X1, X2, X3), for reducing the halo. With respect to the pixels of the second liquid crystal panel 4 corresponding to the high brightness area, regarding the pixels C of the second liquid crystal panel 4 adjacent to the high brightness area on the side not in contact with the low brightness area (but in contact with the high brightness area Z), reduction in transmittance for reducing the halo is not carried out but the transmittance is appropriately determined according to the image instead.

Figure 7:
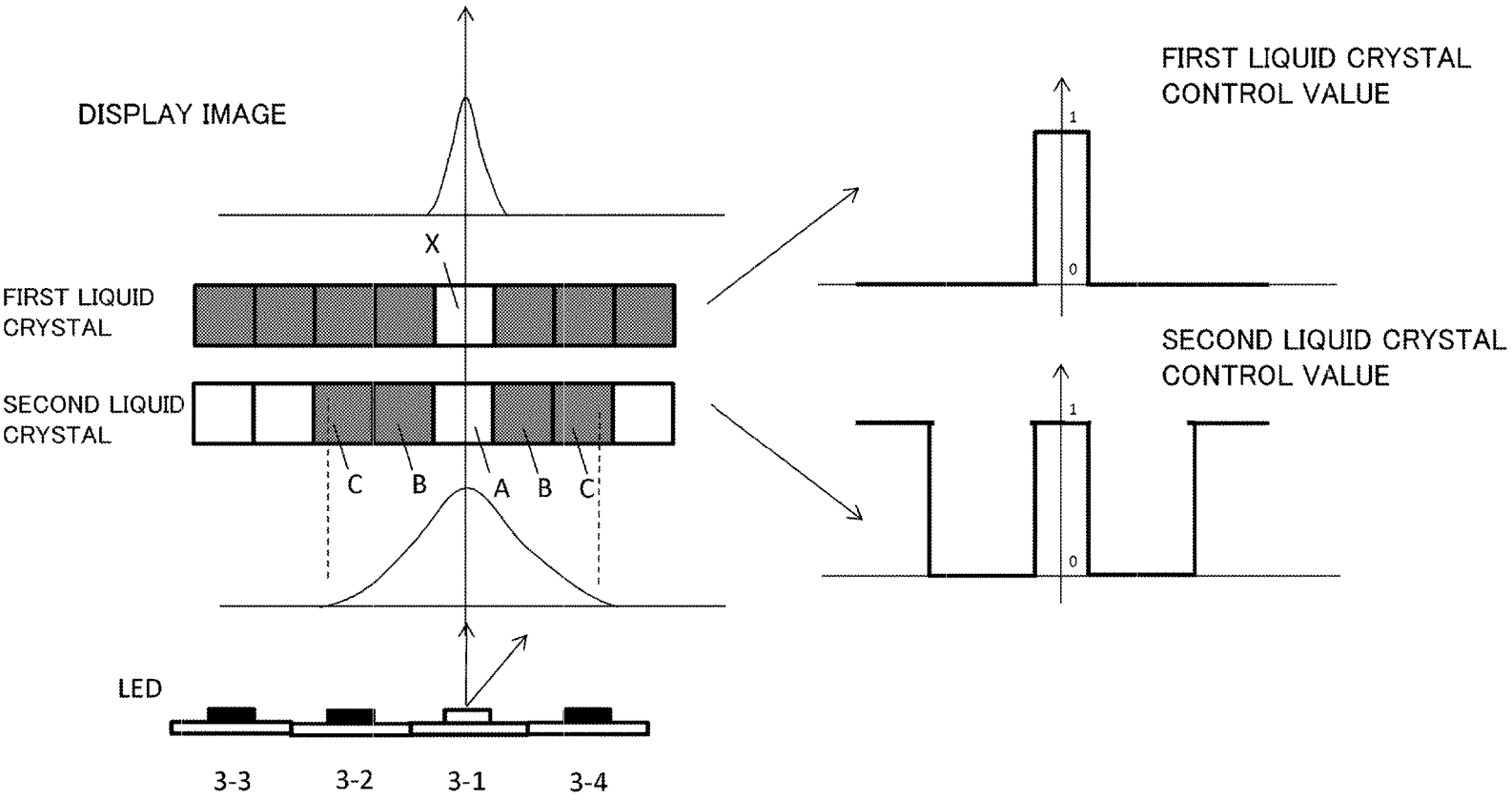
FIG. 7 is a view illustrating control of the second liquid crystal panel 4 and a display image of Example 1.

In the second liquid crystal panel 4, not only for the pixel adjacent to the high brightness area but also for pixels on the outer side therefrom, the transmittance may be reduced for reducing the halo. The range of pixels of the second liquid crystal panel 4 for reducing the halo can be determined on the basis of the range of spread of light emission of an LED corresponding to the high brightness area and an input image. One example is illustrated in FIG. 7. In an example in FIG. 7, a case is illustrated where a partial area of the second liquid crystal panel 4 corresponding to the low brightness area is a partial area located at a predetermined distance from the partial area of the second liquid crystal panel 4 corresponding to the high brightness area. Here, a case is illustrated where the transmittance of a partial area between the partial area of the second liquid crystal panel 4 corresponding to the high brightness area and a partial area of the second liquid crystal panel 4 corresponding to the low brightness area is made to be lower than the transmittance of the partial area of the second liquid crystal panel 4 corresponding to the high brightness area. Among the pixels of the second liquid crystal panel 4, transmittance is reduced, for reducing the halo, for the pixel B adjacent to the pixel A corresponding to the high brightness area X and the pixels C corresponding to the spread of the light from the LED 3-1 on the further outside thereof.

Figure 8:
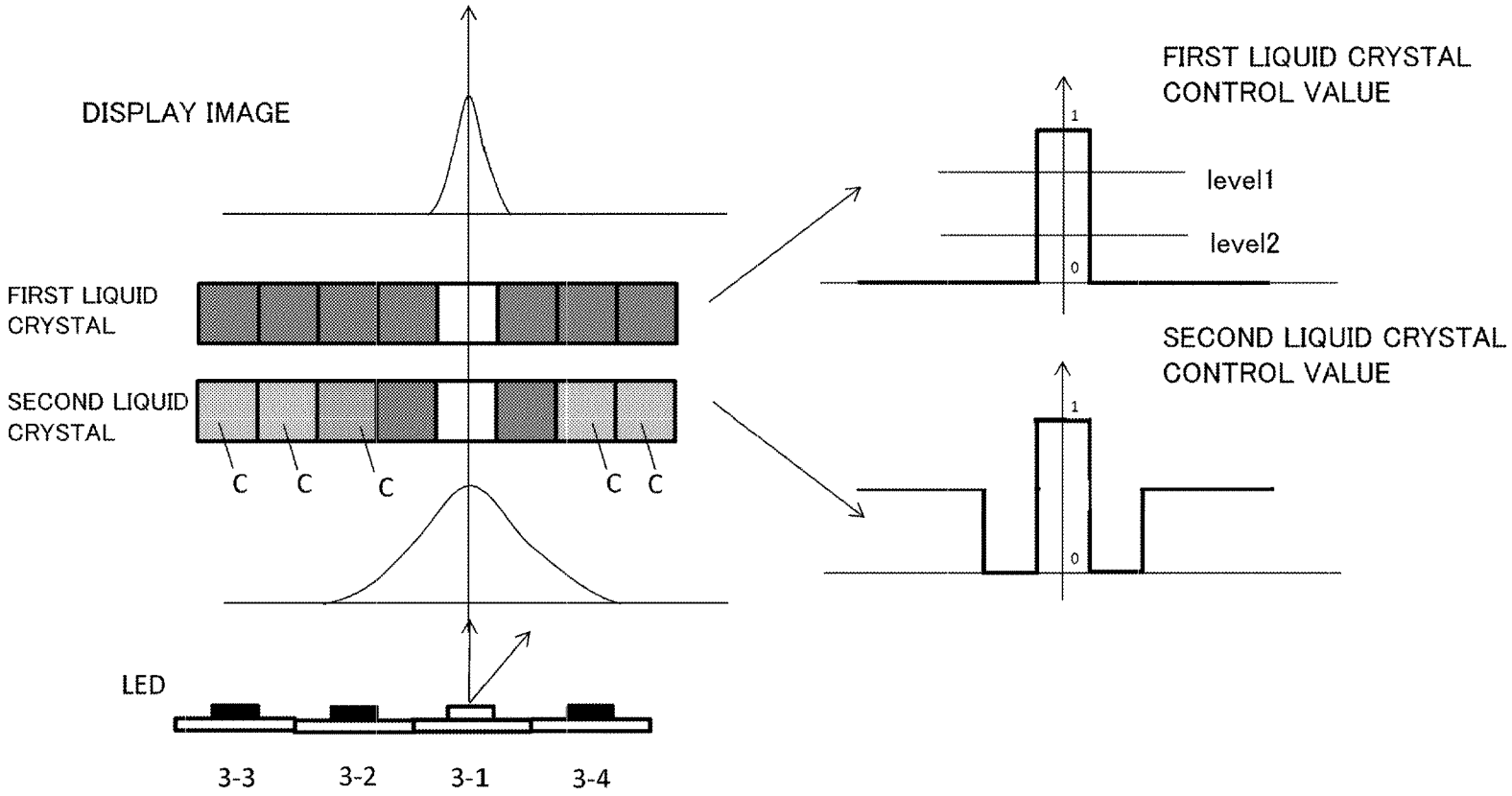
FIG. 8 is a view illustrating control of the second liquid crystal panel 4 and a display image of Example 1.

In the second liquid crystal panel 4, the transmittance of a pixel at a position located far from the high brightness area can be determined in accordance with an input image. In an example of FIG. 8, the transmittance of a partial area C located at a larger distance from the partial area of the second liquid crystal panel 4 corresponding to the high brightness area than the partial area of the second liquid crystal panel 4 corresponding to the low brightness area is controlled to be transmittance between the transmittance of the partial area corresponding to the high brightness area and the transmittance of the partial area corresponding to the low brightness area. In FIG. 8, the transmittance of the pixels C of the second liquid crystal panel 4 at positions corresponding to the LEDs 3-2, 3-3, 3-4 located far from the high brightness area is set at an intermediate value.

Determination about whether a position is adjacent to the high brightness area or not may be made by the following method. The second liquid crystal control unit 8 analyzes image data $Sig_{IMG}$ of FIG. 2, performs spatial differentiation processing of the image, detects an edge, and, when an edge is detected, determines that an image area of high brightness and image area of low brightness are adjacent to each other. The second liquid crystal control unit 8 checks the brightness of pixels on the both sides of the edge, and determines that a pixel located on the side of low brightness is a pixel of a low brightness area located at a position adjacent to the high brightness area. Alternatively, the position of the edge may be determined to correspond to a pixel of the low brightness area located at a position adjacent to the high brightness area. Various methods of spatial differentiation processing for detecting an edge have been developed, and herein, a method of using a Sobel operator, performing first order spatial differentiation processing, is illustrated as one example thereof.

Figures 9A, 9B:
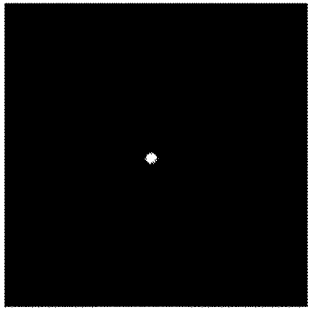
FIG. 9A and FIG. 9B are views illustrating examples of an area of high brightness and a surrounding area and image data of Example 1.

FIG. 9 illustrates an example of an image constituted of a high brightness area and a surrounding low brightness area and an example of image data (pixel values). Here, a pixel value of the image data is normalized by making a maximum value be 1. The brightness value of the pixel corresponding to the central high brightness area is 1 and the brightness value of the pixel corresponding to the surrounding low brightness area is 0.

FIG. 10 illustrates examples of Sobel operators, which are representative operators used for spatial differentiation processing.

FIG. 11 illustrates results obtained by making the Sobel operators of FIG. 10 operate to the image data of FIG. 9. When making a vertical Sobel operator and a horizontal Sobel operator operate separately and calculating a resulting absolute sum, a value of the pixel corresponding to the high brightness area becomes 0 but values of the pixels corresponding to peripheral edge areas become large. A value becomes 0 again when a position becomes far away from the high brightness area. In other words, when the vertical Sobel operator and the horizontal Sobel operator are made to operate to the original image and an absolute sum is calculated, edge parts of the high brightness area have certain values in an image having a high brightness area with a low brightness area as a background. Thus, an edge can be detected.

Figure 12:
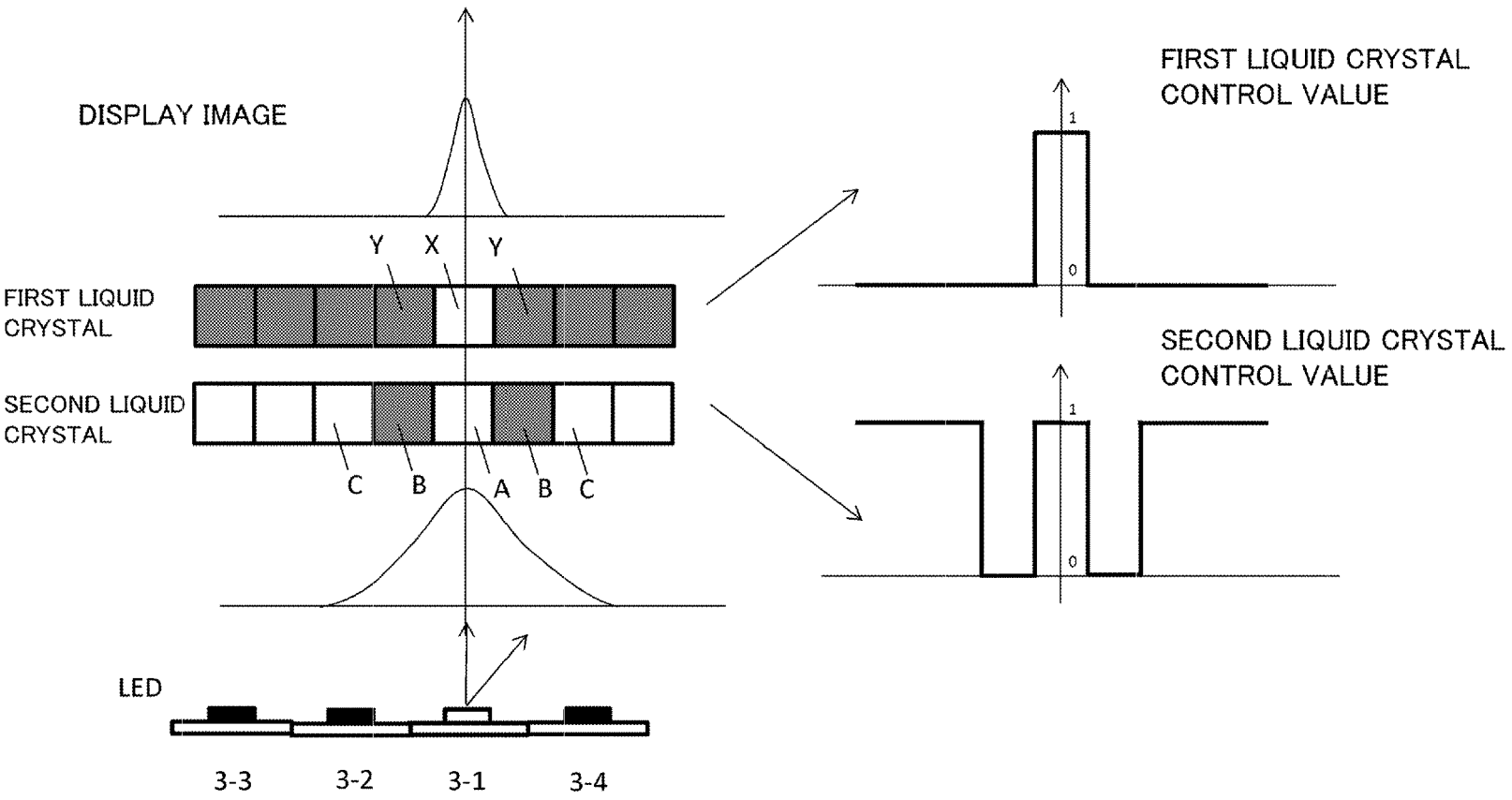
FIG. 12 is a view illustrating an example in which control of the second liquid crystal panel based on the result of FIG. 11 of Example 1 is performed.

FIG. 12 illustrates an example in which the second liquid crystal panel 4 is controlled on the basis of the result of the FIG. 11. With an edge (boundary) detection illustrated in FIG. 11, edges Y of the high brightness area X are detected. On the basis of the detection result, the second liquid crystal control unit 8 determines that pixels B of the second liquid crystal panel 4 at the positions of the edges Y are pixels of a low brightness area adjacent to the high brightness area X. The second liquid crystal control unit 8 performs control so as to make the transmittance of the pixel A of the second liquid crystal panel 4 at a position corresponding to the high brightness area X be high, and make the transmittance of the pixels B adjacent to the high brightness area be low. Thereby, it becomes possible to make the brightness of the low brightness area adjacent to the high brightness area be brightness even lower than the $B_{offset}$. Thus, the brightness level of a halo becomes low and the halo becomes inconspicuous.

Methods of detecting a boundary between a high brightness area and a low brightness area from an input image are different between the control of FIG. 12 and the control of FIG. 3. However, the concept of suppressing a halo by making the transmittance of the pixels of the second liquid crystal panel 4 corresponding to the pixels of the low brightness area located at a position adjacent to the high brightness area be low is the same. Similarly, suppression of a halo may be performed by detecting an edge by performing spatial differentiation processing with respect to an input image and, on the basis thereof, controlling the second liquid crystal panel 4 according to the concept described in regard of FIG. 5 to FIG. 8.

As another example of using the spatial differentiation processing, an example of a method using a Laplace operator of performing second order spatial differentiation processing is illustrated.

FIG. 13 illustrates an example of the Laplace operator.

FIG. 14 illustrates a result of making the Laplace operator of FIG. 13 operate to the image data of FIG. 9. While a value of the pixel corresponding to the high brightness area becomes a positive value, values of pixels corresponding to an outside of the peripheral edge become negative. When being away from the high brightness area, values become 0. In a method of using the Laplace operator, a boundary between the high brightness area and the surrounding low brightness area is represented by a position of a zero-cross where the result of operating of the Laplace operator changes its sign from positive to negative or negative to positive. FIG. 14 illustrates that there is a boundary between the central pixel, which is a high brightness area, and 8 pixels surrounding the center pixel. By comparing the edged detection result of FIG. 14 and the image data of FIG. 9, it can be recognized that the center pixel corresponds to the high brightness area and the 8 pixels surrounding the center pixel and pixels surrounding the 8 pixels correspond to the low brightness area, which constitutes the background of the high brightness area.

Figure 15:
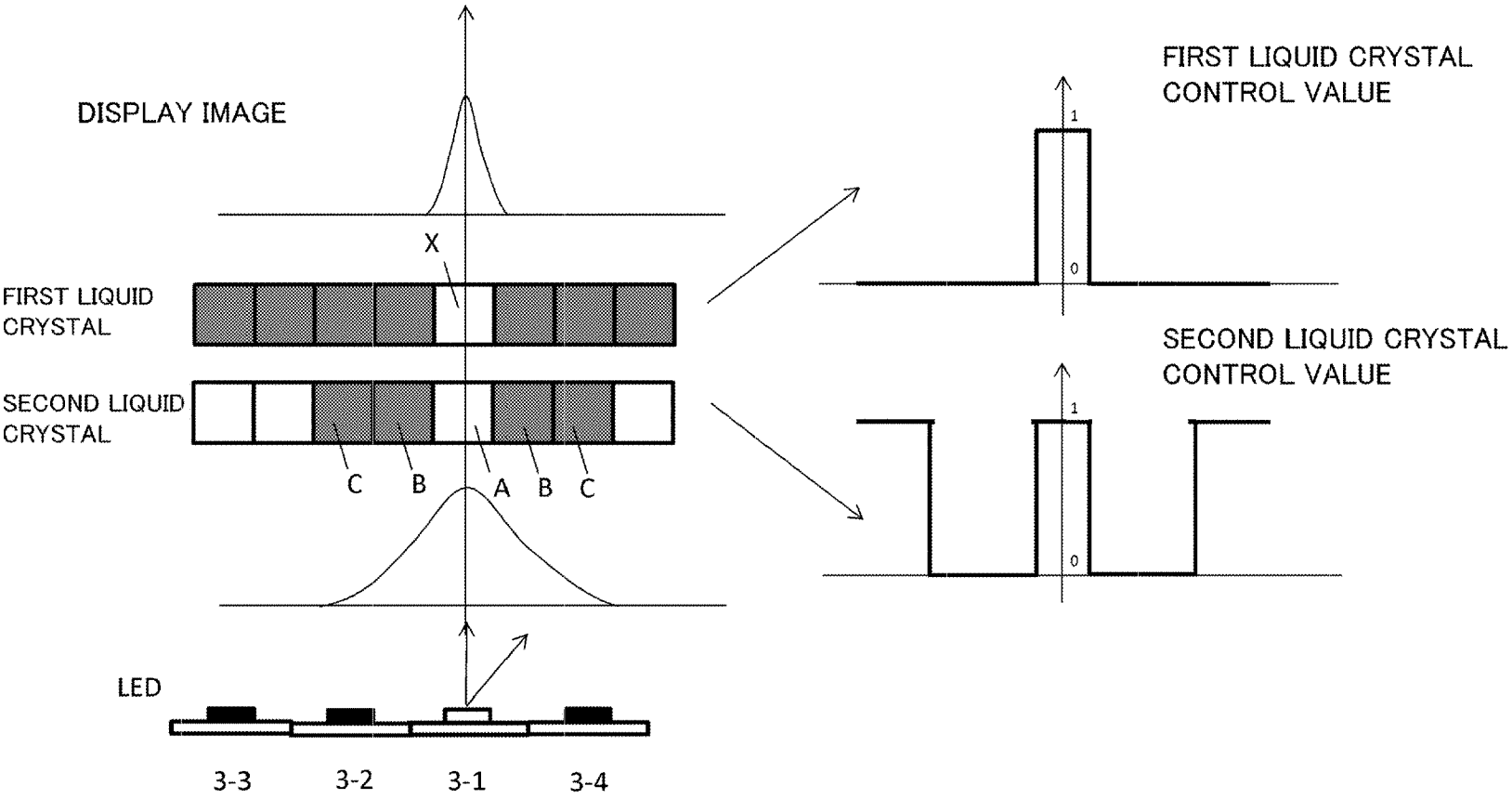
FIG. 15 is a view illustrating an example of control of the second liquid crystal panel 4 based on the result of FIG. 11 of Example 1.

FIG. 15 illustrates control of the second liquid crystal panel 4 with the second liquid crystal control unit 8 based on the edge detection result of FIG. 14. FIG. 15 illustrates that, by reducing the transmittance of the pixels B of the second liquid crystal panel 4 corresponding to the low brightness area adjacent to the high brightness area X and the pixels C of the second liquid crystal panel 4 that are located further on an outer side from the pixels B and included in the spread of the light flux of the LED 3-1 corresponding to the high brightness area, the halo is reduced.

EXAMPLE 2

Although, in Example 1, an example in which pixel sizes (inter-pixel distance) of the first liquid crystal panel 1 and the second liquid crystal panel 4 are equal is illustrated, pixel sizes (inter-pixel distance) of the first liquid crystal panel 1 and the second liquid crystal panel 4 may not necessarily be the same. In Example 2, an example of a case where a pixel size (inter-pixel distance) of the second liquid crystal panel 4 is larger than a pixel size (inter-pixel distance) of the first liquid crystal panel 1 is described. In this configuration, by making the transmittance of the second liquid crystal panel 4 at a maximum control value be high, the energy efficiency of the entire display device can be made high.

Figure 16:
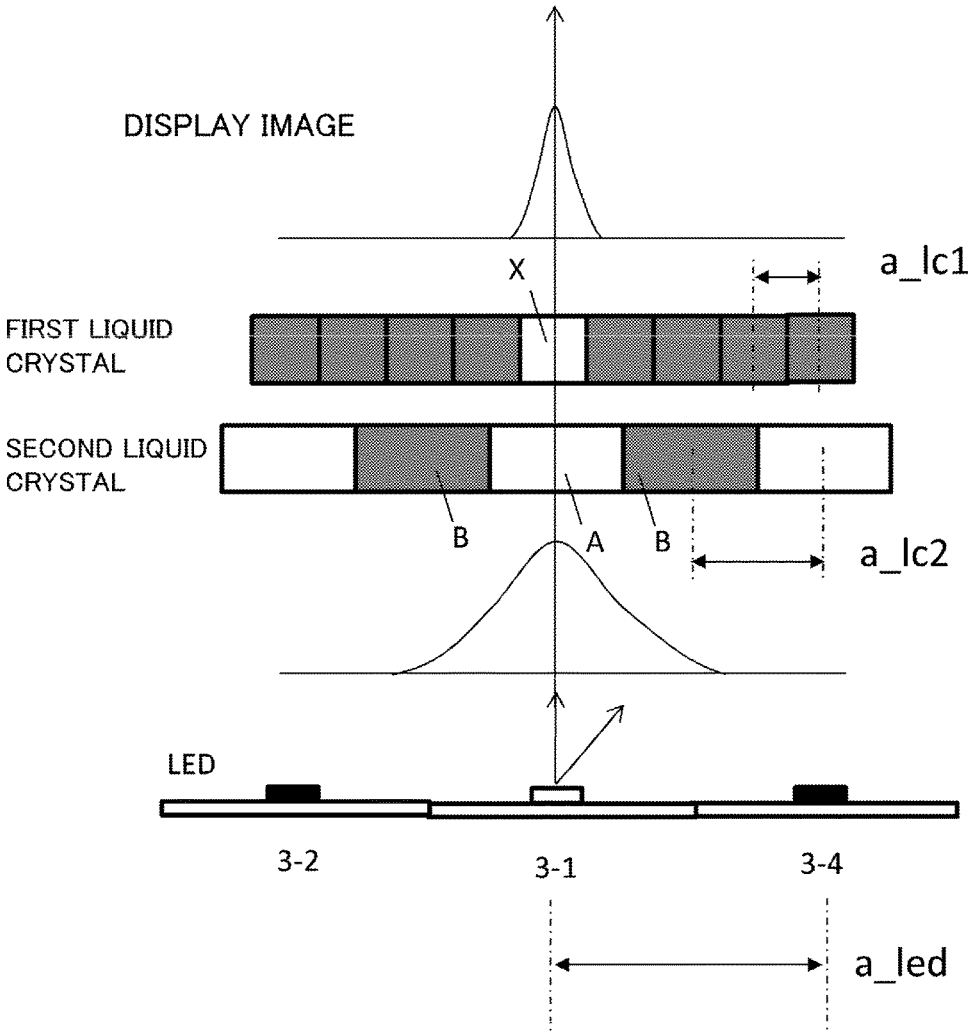
FIG. 16 is a view illustrating a partial cross-section of a display device of Example 2.

FIG. 16 is a cross-sectional view of a display device, which schematically illustrates control of the second liquid crystal panel 4 of Example 2. A difference from Example 1 lies in the second liquid crystal panel 4. In the second liquid crystal panel 4 of Example 2, a distance between pixel centers is larger than a distance between pixel centers of the first liquid crystal panel 1. An inter-LED distance is denoted as a_led, a distance between pixel centers of the first liquid crystal panel 1 is denoted as a_lc1, and a distance between pixel centers of the second liquid crystal panel 4 is denoted as a_lc2. In Example 2, a_lc2=2×a_lc1 is satisfied.

Typically, when a liquid crystal panel is designed to have a large distance between pixel centers, then since an effective aperture ratio at each pixel can be made large and a light flux from the backlight can be effectively utilized for display, the energy efficiency of the entire display device becomes high. The distance between pixel centers a_lc1 of the first liquid crystal panel 1 cannot be made larger than a value determined by the specifications of the entire image display device such as the number of pixels and resolution. However, it is possible to make the distance a_lc2 between pixel centers of the second liquid crystal panel 4 large independently of the specifications of the image display device. Although, in Example 2, an example is illustrated in which the distance a_lc2 between pixel centers of the second liquid crystal panel 4 is made to be two times the distance a_lc1 between pixel centers of the first liquid crystal panel 1, the distance a_lc2 between pixel centers of the second liquid crystal panel 4 is not limited to this case. It is preferable to set the distance a_lc2 between pixel centers of the second liquid crystal panel 4 to be a value between the distance a_lc1 between pixel centers of the first liquid crystal panel 1 and the distance a_led between LEDs of the backlight.

In other words, a_lc2 may be determined so that the formula $$a_lc1 \leq a_lc2 \leq a_led$$

is satisfied. In Example 2, the partial area of the second liquid crystal panel 4 corresponding to the high brightness area corresponds to pixels of the second liquid crystal panel 4 containing the pixels constituting the high brightness area of the image data or pixels of the second liquid crystal panel 4 having a part common with the pixels constituting the high brightness area of the image data. The partial area of the second liquid crystal panel 4 corresponding to the low brightness area corresponds to pixels of the second liquid crystal panel 4 adjacent to pixels of the second liquid crystal panel 4 containing the pixels constituting the high brightness area or pixels of the second liquid crystal panel adjacent to pixels of the second liquid crystal panel 4 having a part common with pixels constituting the high brightness area. A distance between light sources is larger than an inter-pixel distance of the second liquid crystal panel 4. Similarly to FIG. 4 and FIG. 7, pixels of the second liquid crystal panel 4 containing pixels constituting the high brightness area or pixels located at a predetermined distance from pixels of the second liquid crystal panel 4 having a part common with the pixels constituting the high brightness area may be made to be pixels of the second liquid crystal panel 4 corresponding to the low brightness area.

In an input image, the high brightness area X with the low brightness area as a background (the high brightness area and the low brightness area adjacent to each other) is detected, and the transmittance of the pixels B adjacent to the pixel A of the second liquid crystal panel 4 corresponding to the high brightness area X is made low. Since a distance a_lc2 between pixel centers of the second liquid crystal panel 4 is shorter than a distance a_led between LEDs, then by making the transmittance of the pixels B adjacent to the pixel A corresponding to the high brightness area be low, it is possible to suppress a halo caused by light of the LED 3-1. Since the transmittance of the pixel A of the second liquid crystal panel 4 is made to be high, reduction in the display brightness of the high brightness area X can be suppressed. Therefore, keeping the display brightness of the high brightness area and suppression of a halo at the surrounding brightness area can both be achieved suitably.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although, in each Example described above, an example in which a liquid crystal panel is used as a display panel for adjusting the transmittance of light from a backlight is described, the display panel is not limited to the liquid crystal panel. For instance, a display panel of a micro electro mechanical systems (MEMS) shutter system may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-129051, filed on Jun. 26, 2015, which is hereby incorporated by reference herein in its entirety.

What is claimed is:

1. A display device comprising:

a light emitting unit including a plurality of light sources for which light emission can be controlled independently;

a second panel configured to adjust transmittance of light from the light emitting unit; and a first panel configured to adjust transmittance of light from the second panel, the display device being configured to display an image based on image data, further comprising:

a first control unit configured to perform first control with respect to the first panel for controlling transmittance of each pixel on the basis of the image data; and a second control unit configured to perform, in a case where an image area of low brightness is adjacent to an image area of high brightness in the image data, second control for making transmittance of the second panel at a partial area corresponding to the image area of low brightness be lower than transmittance of the second panel at a partial area corresponding to the image area of high brightness.

2. The display device according to claim 1, wherein the partial area of the second panel corresponding to the image area of low brightness is adjacent to the partial area of the second panel corresponding to the image area of high brightness.

3. The display device according to claim 1, wherein the partial area of the second panel corresponding to the image area of low brightness is located at a predetermined distance from the partial area of the second panel corresponding to the image area of high brightness.

4. The display device according to claim 3, wherein the predetermined distance is a distance based on an extent of spread of a light flux from the light source.

5. The display device according to claim 3, wherein the second control unit is, in the second control, configured to make transmittance at a partial area from the partial area of the second panel corresponding to the image area of high brightness to the partial area of the second panel corresponding to the image area of low brightness be equal to the transmittance at the partial area of the second panel corresponding to the image area of high brightness.

6. The display device according to claim 3, wherein the second control unit is, in the second control, configured to make transmittance at a partial area from the partial area of the second panel corresponding to the image area of high brightness to the partial area of the second panel corresponding to the image area of low brightness be lower than the transmittance at the partial area of the second panel corresponding to the image area of high brightness.

7. The display device according to claim 2, wherein the second control unit is, in the second control, configured to control transmittance at a partial area of the second panel located at a larger distance from the partial area of the second panel corresponding to the image area of high brightness than the partial area of the second panel corresponding to the image area of low brightness to be transmittance between the transmittance at the partial area of the second panel corresponding to the image area of high brightness and the transmittance at the partial area of the second panel corresponding to the image area of low brightness.

8. The display device according to claim 1, wherein the second control unit is configured to determine, in a case where areas of which a brightness difference is equal to or larger than a threshold are adjacent to each other in the image data, that an image area of high brightness and an image area of low brightness are adjacent to each other.

9. The display device according to claim 1, wherein the second control unit is configured to detect an edge in the image data, and, in a case where an edge is detected, determine that an image area of high brightness and an image area of low brightness are adjacent to each other.

10. The display device according to claim 9, wherein the second control unit is configured to compare brightness of pixels on both sides of the detected edge and perform the second control while making an area of the pixel of lower brightness be the image area of low brightness and making an area of the pixel of higher brightness be the image area of high brightness.

11. The display device according to claim 1, wherein in a case where, in the image data, a first image area of low brightness having a brightness difference from an image area of high brightness equal to or larger than a threshold is adjacent to the image area of high brightness and a second image area of low brightness having a brightness difference from the image area of high brightness less than the threshold is adjacent to the image area of high brightness on the opposite side to the first image area of low brightness, the second control unit is configured to perform, in the second control, control for making transmittance at the partial area of the second panel corresponding to the first image area of low brightness be lower than transmittance at the partial area of the second panel corresponding to the image area of high brightness.

12. The display device according to claim 1, wherein an inter-pixel distance of the second panel is equal to an inter-pixel distance of the first panel, the partial area of the second panel corresponding to the image area of high brightness corresponds to a pixel of the second panel located in a same position as a position of a pixel constituting the image area of high brightness, and the partial area of the second panel corresponding to the image area of low brightness corresponds to a pixel of the second panel located adjacent to the pixel constituting the image area of high brightness.

13. The display device according to claim 1, wherein an inter-pixel distance of the second panel is equal to an inter-pixel distance of the first panel, the partial area of the second panel corresponding to the image area of high brightness corresponds to a pixel of the second panel located in a same position as a position of a pixel constituting the image area of high brightness, and the partial area of the second panel corresponding to the image area of low brightness corresponds to a pixel of the second panel located at a predetermined distance from the pixel constituting the image area of high brightness.

14. The display device according to claim 1, wherein an inter-pixel distance of the second panel is larger than an inter-pixel distance of the first panel, the partial area of the second panel corresponding to the image area of high brightness corresponds to a pixel of the second panel containing a pixel constituting the image area of high brightness or a pixel of the second panel having a common area with the pixel constituting the image area of high brightness, and the partial area of the second panel corresponding to the image area of low brightness corresponds to a pixel of the second panel located adjacent to the pixel of the second panel containing the pixel constituting the image area of high brightness or a pixel of the second panel located adjacent to the pixel of the second panel having a common area with the pixel constituting the image area of high brightness.

15. The display device according to claim 14, wherein an inter-light source distance of the light emitting unit is larger than the inter-pixel distance of the second panel.

16. The display device according to claim 1, wherein an inter-pixel distance of the second panel is larger than an inter-pixel distance of the first panel, the partial area of the second panel corresponding to the image area of high brightness corresponds to a pixel of the second panel containing a pixel constituting the image area of high brightness or a pixel of the second panel having a common part with the pixel constituting the image area of high brightness, and the partial area of the second panel corresponding to the image area of low brightness corresponds to a pixel of the second panel located apart by a predetermined distance from the pixel of the second panel containing the pixel constituting the image area of high brightness or a pixel of the second panel located apart by a predetermined distance from the pixel of the second panel having a common area with the pixel constituting the image area of high brightness.

17. The display device according to claim 1, further comprising a third control unit configured to control brightness of each of the light sources on the basis of a feature amount of the image data of an area corresponding to each of the light sources.

18. The display device according to claim 17, wherein the third control unit is so configured as to make brightness of a light source corresponding to the image area of low brightness be lower than brightness of a light source corresponding to the image area of high brightness, or to put out the light source.

19. A control method for a display device configured to display an image based on image data, the device including a light emitting unit including a plurality of light sources for which light emission can be controlled independently, a second panel configured to adjust transmittance of light from the light emitting unit, and a first panel configured to adjust transmittance of light from the second panel, the control method comprising:

a step of performing first control with respect to the first panel for controlling transmittance of each pixel on the basis of the image data; and a step of performing second control for, in a case where an image area of low brightness is adjacent to an image area of high brightness in the image data, making transmittance of the second panel at a partial area corresponding to the image area of low brightness be lower than transmittance of the second panel at a partial area corresponding to the image area of high brightness.

20. A non-transitory computer readable medium storing a program for making a computer perform each step of a control method for a display device configured to display an image based on image data, the device including a light emitting unit including a plurality of light sources for which light emission can be controlled independently, a second panel configured to adjust transmittance of light from the light emitting unit, and a first panel configured to adjust transmittance of light from the second panel, the control method comprising:

a step of performing first control with respect to the first panel for controlling transmittance of each pixel on the basis of the image data; and a step of performing second control for, in a case where an image area of low brightness is adjacent to an image area of high brightness in the image data, making transmittance of the second panel at a partial area corresponding to the image area of low brightness be lower than transmittance of the second panel at a partial area corresponding to the image area of high brightness.

* * * * *